US006170571B1

(12) United States Patent
Ohmer

(10) Patent No.: US 6,170,571 B1
(45) Date of Patent: Jan. 9, 2001

(54) APPARATUS FOR ESTABLISHING BRANCH WELLS AT A NODE OF A PARENT WELL

(75) Inventor: Hervé Ohmer, Houston, TX (US)

(73) Assignee: Schlumberger Technology Corporation, Sugar Land, TX (US)

( * ) Notice: Under 35 U.S.C. 154(b), the term of this patent shall be extended for 0 days.

(21) Appl. No.: 09/259,841

(22) Filed: Mar. 1, 1999

Related U.S. Application Data

(62) Division of application No. 08/798,591, filed on Feb. 11, 1997, now Pat. No. 5,944,107.

(60) Provisional application No. 60/013,227, filed on Mar. 11, 1996, and provisional application No. 60/025,033, filed on Aug. 27, 1996.

(51) Int. Cl.[7] ..... E21B 29/00

(52) U.S. Cl. ..... 166/65.1; 166/72

(58) Field of Search ..... 166/65.1, 67, 72, 166/206, 207; 72/370.06, 370.07, 370.08, 220, 214

(56) References Cited

U.S. PATENT DOCUMENTS

| | | | | |
|---|---|---|---|---|
| 958,517 | * | 5/1910 | Mettler | 166/217 |
| 2,397,070 | | 3/1946 | Zublin . | |
| 2,452,920 | | 11/1948 | Gilbert . | |
| 2,797,893 | | 7/1957 | McCune et al. . | |
| 2,858,107 | | 10/1958 | Colmerauer . | |

(List continued on next page.)

FOREIGN PATENT DOCUMENTS

| | | |
|---|---|---|
| 0525991 | 2/1993 | (EP) . |
| 0574326 | 12/1993 | (EP) . |
| 2737534 | 2/1997 | (FR) . |
| 2274864 | 1/1996 | (GB) . |
| 9623953 | 8/1996 | (WO) . |
| 9807957 | 2/1998 | (WO) . |

OTHER PUBLICATIONS

Halliburton Advertisement in *Oil & Gas Journal,* May 13, 1996, "Always Raising the Bar in a Multilaterial Technology".

Brockman, Mar, "Multilateral Completions Prepare to Take Off", *Petroleum Engineer International* (Jan. 1996), pp. 49–50.

Baker Hughes Advertisement "Multi–Lateral Completion Systems from Baker Oil Tools", *Petroleum Engineer International* (Jan. 1996), p. 52.

Themig, Dan, "Planning and Evaluation Are Crucial to Multilateral Wells", *Petroleum Engineer International* (Jan. 1996), pp. 53, 56, 57.

(List continued on next page.)

*Primary Examiner*—Hoang Dang
(74) *Attorney, Agent, or Firm*—Gary L. Bush; Wayne I. Kanak

(57) ABSTRACT

A method and apparatus for creating multiple branch wells from a parent well is disclosed. A multiple branching sub is provided for placement at a branching node of a well. Such sub includes a branching chamber and a plurality of branching outlet members. The outlet members during construction of the branching sub, have previously been distorted into oblong shapes so that all of the branching outlet members fit within an imaginary cylinder which is coaxial with and substantially the same radius as the branching chamber. After deployment of the branching sub via a parent casing in the well, a forming tool is lowered to the interior of the sub. The outlet members are extended outwardly by the forming tool and simultaneously formed into substantially round tubes. Next, each outlet member is plugged with cement, after which each branch well is drilled through a respective outlet member. If desired, each branch may be lined with casing and sealed to a branching outlet by means of a casing hanger. A manifold placed in the branching chamber controls the production of each branch well to the parent well.

7 Claims, 19 Drawing Sheets

U.S. PATENT DOCUMENTS

| | | | | |
|---|---|---|---|---|
| 3,179,168 | * | 4/1965 | Vincent | 166/277 |
| 3,191,677 | * | 6/1965 | Kinley | 166/277 |
| 3,330,349 | | 7/1967 | Owsley et al. . | |
| 3,489,220 | * | 1/1970 | Kinley | 166/277 |
| 3,776,307 | * | 12/1973 | Young | 166/125 |
| 3,950,461 | | 4/1976 | Levens . | |
| 4,029,428 | | 6/1977 | Levens . | |
| 4,245,970 | | 1/1981 | St. Onge . | |
| 4,309,891 | * | 1/1982 | Pogonowski | 72/399 |
| 4,396,075 | | 8/1983 | Wood et al. . | |
| 4,402,551 | | 9/1983 | Wood et al. . | |
| 4,415,205 | | 11/1983 | Rehm et al. . | |
| 4,444,276 | | 4/1984 | Peterson, Jr. . | |
| 4,515,213 | | 5/1985 | Rogen et al. . | |
| 4,573,541 | | 3/1986 | Josse et al. . | |
| 4,807,704 | | 2/1989 | Hsu et al. . | |
| 4,817,716 | * | 4/1989 | Taylor et al. | 166/277 |
| 4,893,389 | | 1/1990 | Allen et al. . | |
| 5,040,922 | | 8/1991 | Himmler . | |
| 5,301,760 | | 4/1994 | Graham . | |
| 5,311,936 | | 5/1994 | McNair et al. . | |
| 5,318,121 | | 6/1994 | Brockman et al. . | |
| 5,318,122 | | 6/1994 | Murray et al. . | |
| 5,322,127 | | 6/1994 | McNair et al. . | |
| 5,325,924 | | 7/1994 | Bangert et al. . | |
| 5,330,007 | | 7/1994 | Collins et al. . | |
| 5,337,808 | | 8/1994 | Graham . | |
| 5,353,876 | | 10/1994 | Curington et al. . | |
| 5,366,012 | * | 11/1994 | Lohbeck | 166/277 |
| 5,388,648 | | 2/1995 | Jordan, Jr. . | |
| 5,398,754 | | 3/1995 | Dinhoble . | |
| 5,411,082 | | 5/1995 | Kennedy . | |
| 5,427,177 | | 6/1995 | Jordan, Jr. et al. . | |
| 5,435,392 | | 7/1995 | Kennedy . | |
| 5,439,051 | | 8/1995 | Kennedy et al. . | |
| 5,454,430 | | 10/1995 | Kennedy et al. . | |
| 5,458,199 | | 10/1995 | Collins et al. . | |
| 5,458,209 | | 10/1995 | Hayes et al. . | |
| 5,462,120 | | 10/1995 | Gondouin . | |
| 5,472,048 | | 12/1995 | Kennedy et al. . | |
| 5,474,131 | | 12/1995 | Jordan, Jr. et al. . | |
| 5,477,923 | | 12/1995 | Jordan, Jr. et al. . | |
| 5,477,925 | | 12/1995 | Trahan et al. . | |
| 5,494,106 | | 2/1996 | Gueguen et al. . | |
| 5,520,252 | | 5/1996 | McNair . | |
| 5,526,880 | | 6/1996 | Jordan, Jr. et al. . | |
| 5,655,602 | | 8/1997 | Collins . | |
| 5,685,373 | | 11/1997 | Collins et al. . | |
| 5,730,224 | | 3/1998 | Williamson et al. . | |
| 6,070,671 | * | 6/2000 | Cumming et al. | 166/381 |

OTHER PUBLICATIONS

Sperry–Sun Drilling Services Advertisement, "Multi–Lateral Drilling and Completions,", *Petroleum Engineer International* (Jan. 1996), pp. 54–55.

Collins, Dan, "Single–Size Reduction Offers Workover, Completion Advantages", *Petroleum Engineer International* (Jan. 1996), pp. 59–62.

"Wellbore Stabilization Using the Isolation Profile Liner", TatNIPIneft Institute, Tatarstan, Russia, 25 pages, no date.

"Technique and Technology of Local Well Casing", TatNIPIneft Institute, Tatarstan, no date.

"Multilateral Technology: Taking Horizontal Wells To The Next Level" a supplement to *Petroluem Engineer International* (1997).

Sugiyama, Hironori, et al., "The Optimal Application of Multi–Lateral/Multi–Branch Completions", SPE Paper 38033 presented at the 1997 SPE Asia Pacific Oil and Gas Conference, Kuala Lumpur, Apr. 14–16, 1997.

* cited by examiner

Ds1=Ds2 → Dc/Do=1.35
Sc/So=1.82

FIG. 5A
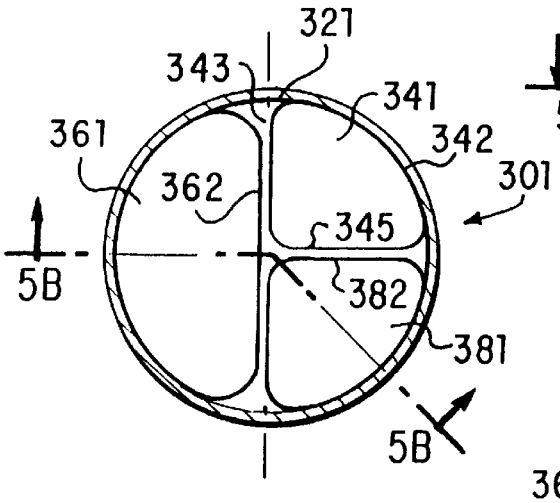
FIG. 5B
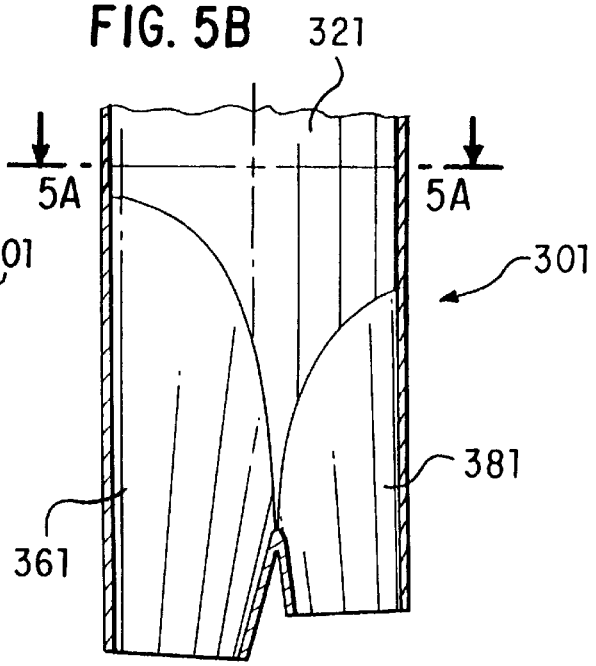
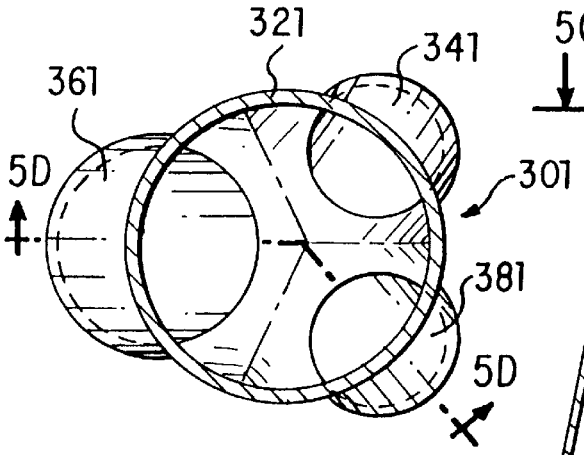
FIG. 5C
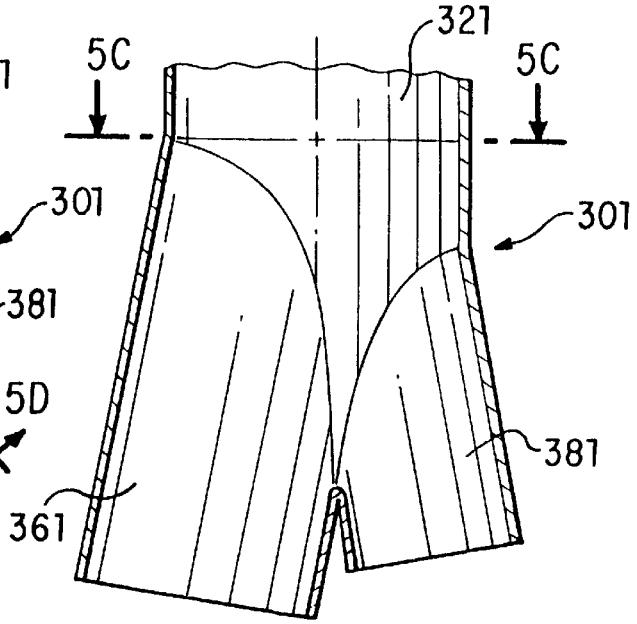
FIG. 5D $C = \pi \times Ds/2 + Ds$ $Dc = Ds/2$ $Do = C/\pi = Ds/2 + Ds/\pi$ $C = \pi \times Ds/3 + Ds$ $Dc = 3Ds/(3 + 2\sqrt{3})$ $Do = C/\pi = Ds/3 + Ds/\pi$

FIG. .4A

APPARATUS FOR ESTABLISHING BRANCH WELLS AT A NODE OF A PARENT WELL

CROSS-REFERENCE TO RELATED APPLICATIONS

This is a division of application Ser. No. 08/798,591, filed Feb. 11, 1997, now U.S. Pat. No. 5,944,107. This application claims priority from Provisional Application No. 60/013,227, filed Mar. 11, 1996, and Provisional Application No. 60/025,033, filed Aug. 27, 1996, the contents of which are incorporated herein by reference.

BACKGROUND OF THE INVENTION

1. Field of the Invention

This invention relates generally to the field of wells, particularly to the field of establishing branch wells from a parent hydrocarbon well. More particularly the invention relates to establishing multiple branch wells from a common depth point, called a node, deep in the well.

2. Description of the Related Art

Multiple wells have been drilled from a common location, particularly while drilling from an offshore platform where multiple wells must be drilled to cover the great expenses of offshore drilling. As illustrated in FIGS. 1A and 1B, such wells are drilled through a common conductor pipe, and each well includes surface casing liners, intermediate casing and parent casing as is well known in the field of offshore drilling of hydrocarbon wells.

Branch wells are also known in the art of well drilling as illustrated in FIG. 2. Branch wells are created from the parent well, but necessarily the parent well extends below the branching point of the primary well. As a result, the branching well is typically of a smaller diameter than that of the primary well which extends below the branching point. Furthermore, difficult sealing problems have faced the art for establishing communication between the branch well and the primary well.

For example, U.S. Pat. No. 5,388,648 describes methods relating to well juncture sealing with various sets of embodiments to accomplish such sealing. The disclosure of the '648 patent proposes solutions to several serious sealing problems which are encountered when establishing branches in a well. Such sealing problems relate to the requirement of ensuring the connectivity of the branch casing liner with the parent casing and to maintaining hydraulic isolation of the juncture under differential pressure.

A fundamental problem exists in establishing branch wells at a depth in a primary well in that apparatus for establishing such branch wells must be run on parent casing which must fit within intermediate casing of the well. Accordingly, any such apparatus for establishing branch wells must have an outer diameter which is essentially no greater than that of the parent casing. Furthermore, it is desirable that when branch wells are established, they have as large a diameter as possible. Still further, it is desirable that such branch wells be lined with casing which may be established and sealed with the branching equipment with conventional casing hangers.

An important object of this invention is to provide an apparatus and method by which multiple branches connect to a primary well at a single depth in the well where the branch wells are controlled and sealed with respect to the primary well with conventional liner-to-casing connections.

Another important object of this invention is to provide a multiple outlet branching sub having an outer diameter such that it may be run in a well to a deployment location via primary casing.

Another object of this invention is to provide a multiple outlet branching sub in which multiple outlets are fabricated in a retracted state and are expanded while downhole at a branching deployment location to produce maximum branch well diameters rounded to provide conventional liner-to-casing connections.

Another object of this invention is to provide apparatus for downhole expansion of retracted outlet members in order to direct each outlet into an arcuate path outwardly from the axis of the primary well and to expand the outlets into an essentially round shape such that after a branch well is drilled through an outlet, conventional liner-to-casing connections can be made to such outlet members.

SUMMARY OF THE INVENTION

These objects and other advantages and features are provided in a method and apparatus for establishing multiple branch wells from a parent well. A multiple branching sub is provided for deployment in a borehole by means of a parent casing through a parent well. The branching sub includes a branching chamber which has an open first end of cylindrical shape. The branching chamber has a second end to which branching outlet members are connected. The first end is connected to the parent well casing in a conventional manner, such as by threading, for deployment to a branching location in the parent well.

Multiple branching outlet members, each of which is integrally connected to the second end of the branching chamber, provide fluid communication with the branching chamber. Each of the outlet members is prefabricated such that such members are in a retracted position for insertion of the sub into and down through the parent well to a deployment location deep in the well. Each of the multiple outlets is substantially totally within an imaginary cylinder which is coaxial with and of substantially the same radius as the first end of the branching chamber. The prefabrication of the outlet members causes each outlet member to be transformed in cross-sectional shape from a round or circular shape to an oblong or other suitable shape such that its outer profile fits within the imaginary cylinder. The outer profile of each outlet member cooperates with the outer profiles of other outlet members to substantially fill the area of a cross-section of the imaginary cylinder. As a result, a substantially greater cross-sectional area of the multiple outlet members is achieved within a cross-section of the imaginary cylinder as compared with a corresponding number of tubular multiple outlet members of circular cross-section.

The multiple outlet members are constructed of a material which may be plastically deformed by cold forming. A forming tool is used, after the multiple branching sub is deployed in the parent well, to expand at least one of the multiple branching outlet members outwardly from the connection to the branching chamber. Preferably all of the outlet members are expanded simultaneously. Simultaneously with the outward expansion, the multiple outlets are expanded into a substantially circular radial cross-sectional shape along their axial extent.

After the multiple outlet members which branch from the branching chamber are expanded, each of the multiple branching outlets are plugged. Next, a borehole is drilled through a selected one of the multiple branching outlets. A substantially round liner is provided through the selected branching outlet and into the branch well. The liner of circular cross-section is sealed to the selected branching outlet circular cross-section by means of a conventional casing hanger. A borehole and liner is established for a plurality of the multiple branching outlets. A downhole manifold is installed in the branching chamber. Next multiple branch wells are completed. The production of each branch well to the parent well is controlled with the manifold.

The apparatus for expanding an outlet of the multiple branching sub includes an uphole power and control unit and a downhole operational unit. An electrical wireline connects the uphole power and control unit and the downhole operational unit. The wireline provides a physical connection for lowering the downhole operational unit to the branching sub and provides an electrical path for transmission of power and bidirectional control and status signals.

The downhole operational unit includes a forming mechanism arranged and designed for insertion in at least one retracted branching outlet member of the sub (and preferably into all of the outlet members at the same time) and for expanding the outlet member outwardly from its imaginary cylinder at deployment. Preferably each outlet member is expanded outwardly and expanded to a circular radial cross-section simultaneously. The downhole operational unit includes latching and orientation mechanisms which cooperate with corresponding mechanisms of the sub. Such cooperating mechanisms allow the forming mechanism to be radially oriented within the multiple branching sub so that it is aligned with a selected outlet of the sub and preferably with all of the outlets of the sub. The downhole operational unit includes a hydraulic pump and a head having hydraulic fluid lines connected to the hydraulic pump. The forming mechanism includes a hydraulically powered forming pad. A telescopic link between each forming pad and head provides pressurized hydraulic fluid to the forming pads as they move downwardly while expanding the outlet members.

BRIEF DESCRIPTION OF THE DRAWINGS

The objects, advantages and features of the invention will become more apparent by reference to the drawings which are appended hereto and wherein an illustrative embodiment of the invention is shown, of which:

FIG. 3A is a radial cross-section through the branching outlets of the sub, with one outlet completely in a retracted position, with another outlet in a position between its retracted position and its fully expanded position, and the third outlet being in a fully expanded position, and where FIG. 3B is a radial cross-section through the branching outlets of the sub with each of the outlets fully expanded after deployment in a parent well, and FIG. 3C is an axial cross-section of the branching sub showing two of the branching outlets fully expanded to a round shape in which casing has been run into a branch well and sealed with respect to the branching outlets by means of conventional liner hanging packers.

FIGS. 5A, 5B, 5C, and 5D illustrate configurations of the present invention with asymmetrical branching outlets with at least one outlet having larger internal dimensions than the other two, with FIG. 5A being a radial cross-section through the branching outlets along line 5A—5A in a retracted position, with FIG. 5B being an axial cross-section through the lines 5B—5B of FIG. 5A, with FIG. 5C being a radial cross-section along lines 5C—5C of FIG. 5D with the branching outlets in an expanded position, and with FIG. 5D being an axial cross-section along lines 5D–5D of FIG. 5C with the branching outlets in an expanded position;

FIGS. 14A–14D are illustrative sketches of nodal branching according to the invention where FIG. 14A illustrates establishing a node in a parent well and establishing branch wells at a common depth point in the parent well, all of which communicate with a parent well at the node of the parent well; with FIG. 14B illustrating an expanded branching sub which has had its branching outlets expanded beyond the diameter of the parent casing and formed to be substantially round; with FIG. 14C illustrating using a primary node and secondary nodes to produce hydrocarbons from a single strata; and with FIG. 14D illustrating using an expanded branching sub from a primary node to reach multiple subterranean targets;

DESCRIPTION OF THE PREFERRED EMBODIMENTS

Figure 1A:
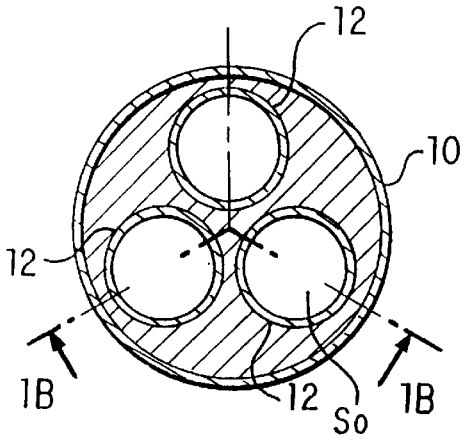
FIG. 1A PRIOR ART
FIGS. 1A and 1B illustrate a prior art triple liner packed in a conductor casing termination in which the outlet members are round during installation and are packed to fit within the conductor casing.
Figure 1B:
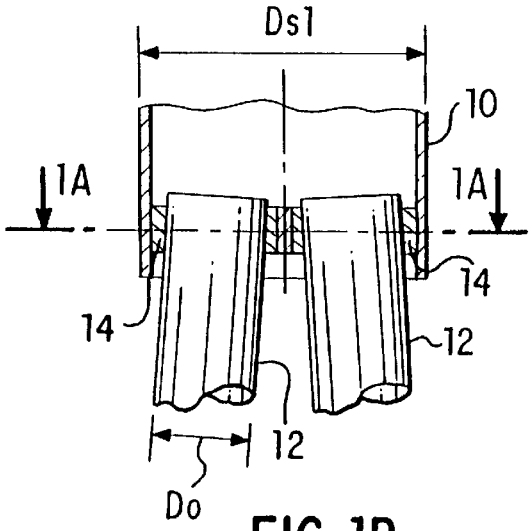
FIG. 1B PRIOR ART

As described above, FIGS. 1A and 1B illustrate the problems with prior art apparatus and methods for establishing branch wells from a parent well. FIGS. 1A and 1B show radial and axial cross-sections of multiple outlet liners 12 hung and sealed from a large diameter conductor pipe 10. The outlets are round in order to facilitate use of conventional lining hanger packers 14 to seal the outlet liners 12 for communication with the conductor pipe 10. The arrangement of FIGS. 1A and 1B requires that multiple round outlets of diameter Do fit within the diameter Ds1 of the conductor pipe 10. In many cases, especially where the conductor pipe must be deployed at a depth in the well, rather than at the surface of the well, it is not feasible to provide a borehole of sufficient outer diameter to allow branch well outlets of sufficient diameter to be installed.

Figure 2:
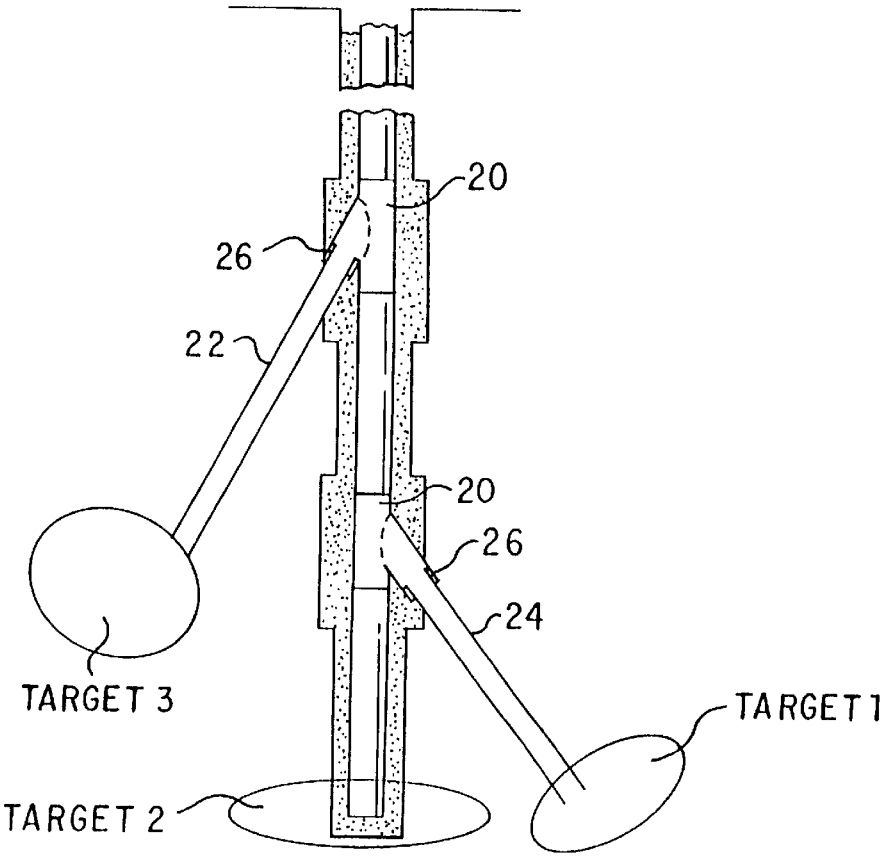
FIG. 2 PRIOR ART
FIG. 2 illustrates a prior art parent or vertical well and lateral branch wells which extend therefrom.

The technique of providing branch wells according to the prior art arrangement depicted in FIG. 2 creates branch wells 22, 24 from a primary well 20. Special sealing arrangements 26, unlike conventional casing hangers, must be provided to seal a lined branch well 22, 24 to the primary well 20.

Description of Branching Sub According to the Invention

Figure 3A:
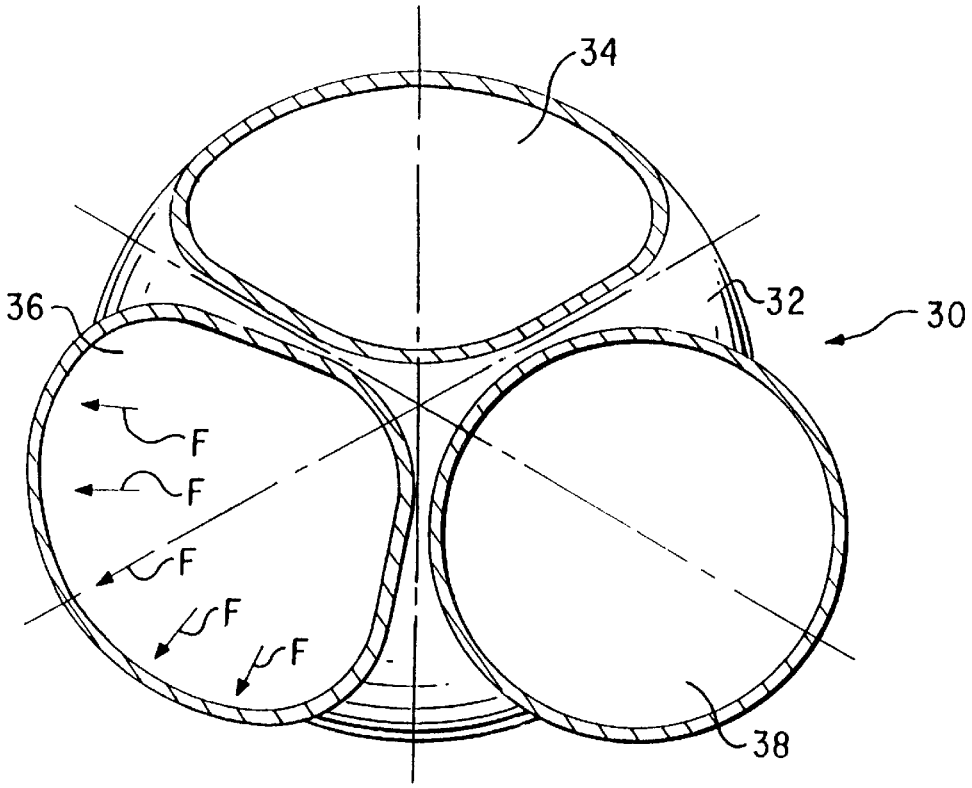
FIGS. 3A, 3B, and 3C illustrate a three outlet branching sub according to the present invention where
Figure 3B:
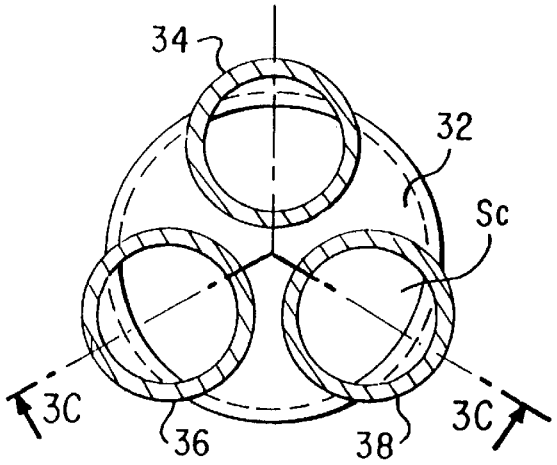
Figure 3C:
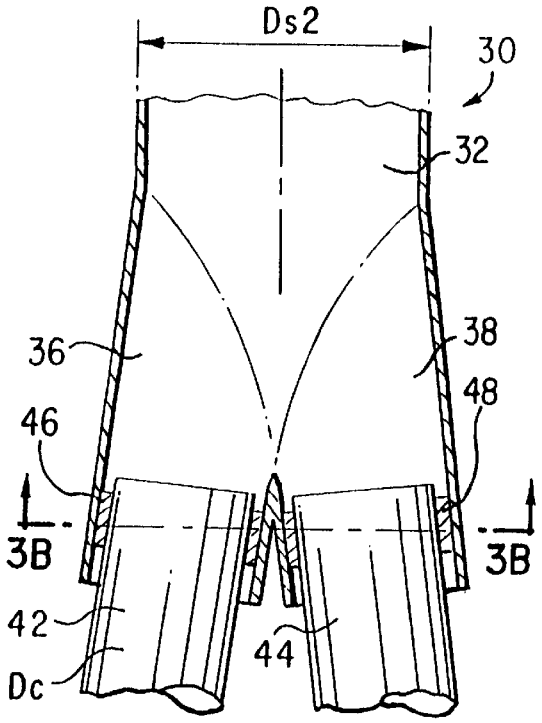

FIGS. 3A, 3B, and 3C illustrate a branching sub 30 according to the invention. The branching sub includes a branching chamber 32, (which may be connected to and carried by parent well casing (See parent casing 604 of FIG. 12)), and multiple outlet members, for example three outlet members 34, 36, 38 illustrated in FIGS. 3A, 3B, and 3C. FIG. 3A is a radial cross-section view through the branching chamber 32 which illustrates one outlet member 34 in a retracted state, a second outlet member 36 in the state of being expanded outwardly, and a third outlet member 38 which has been fully expanded outwardly. (FIG. 3A is presented for illustrative purposes, because according to the invention it is preferred to expand and circularize each of the outlets simultaneously.) In the retracted state, each outlet is deformed as shown particularly for outlet member 34. A round tube is deformed such that its cross-sectional interior area remains essentially the same as that of a circular or round tube, but its exterior shape is such that it fits cooperatively with the deformed shape of the other outlet members, all within an imaginary cylinder having a diameter essentially the same as that of the branching chamber 32. In that way the branching chamber 32 and its retracted outlet members have an effective outer diameter which allows it to be run in a parent well to a deployment location while attached to a parent casing. Outlet member 34 in its retracted state is illustrated in an oblong shape, but other retracted shapes may also prove to have advantageous characteristics. For example, a concave central area of deformation in the outer side of a retracted outlet member may be advantageous to provide a stiffer outlet member. Such deformation is progressively greater and deeper starting from the top to the bottom of the outlet member.

FIG. 3A shows outlet member 36 in a state of being expanded in an arcuate path outwardly from the branching chamber 32 while simultaneously being rounded by a downhole forming-expanding tool that is described below. The arrows labeled F represent forces being applied from the interior of the outlet member 36 in order to expand that outlet member both outwardly in an arcuate path away from branching chamber 32 and to circularize it from its retracted state (as is the condition of outlet member 34) to its expanded or fully deployed state like outlet member 38.

FIG. 3B is a radial cross-section as viewed by lines 3B—3B of FIG. 3C through the branching sub 30 at the level of outlet members 36, 38. FIG. 3C illustrates conventional casing liners 42, 44 which have been installed through branching chamber 32 and into respective outlet members 36, 38. Conventional liner hanging packers 46,48 seal casing liners 42, 44 to outlet members 36, 38. As illustrated in FIGS. 3B and 3C, if the diameter Ds2 of the branching chamber 32 is the same as the diameter Ds1 of the conductor pipe of prior art FIG. 1B, then the outlet diameter $D_c$ of FIG. 3C is 1.35 times as great as the outer diameter $D_o$ of FIG. 1B. The liner cross-sectional area $S_c$ of the sub of FIG. 3C is 1.82 times as great as the liner cross-sectional area So of FIG. 1A. When fully expanded, the effective diameter of the expanded outlet members 34, 36, 38 exceeds that of the branching chamber 32.

Figure 4:
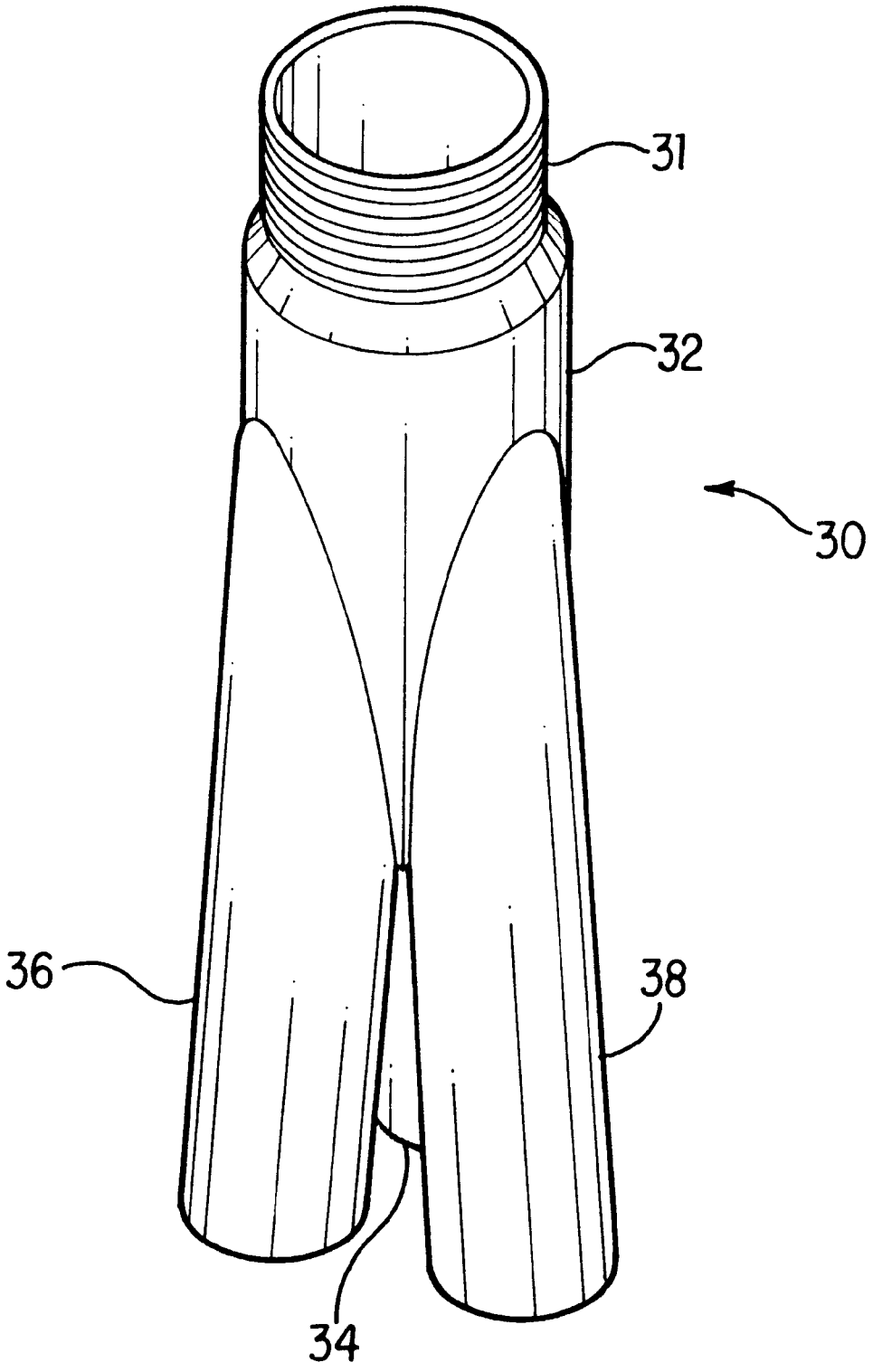
FIG. 4 is a perspective view of a three symmetrical outlet branching sub of the present invention with the outlet branches expanded.

FIG. 4 is a perspective view of the branching sub 30 of FIGS. 3A, 3B, 3C where the branching sub is shown after expansion. Threads 31 are provided at the top end of branching chamber 32. Threads 31 enable branching sub 30 to be connected to a parent casing for deployment at a subterranean location. Outlet members 34, 36, 38 are shown expanded as they would look downhole at the end of a parent well.

FIGS. 5A–5D illustrate an alternative three outlet branching sub 301 according to the invention. FIGS. 5A and 5B illustrate in radial and axial cross-section views the sub 301 in its retracted position. Outlet members 341, 361 and 381 are illustrated with outlet member 361 being about equal to the combined radial cross-sectional area of outlet members 341 and 381 combined. Each of the outlet members are deformed inwardly from a round tubular shape to the shapes as illustrated in FIG. 5A whereby the combined deformed areas of outlet members 341, 361 and 381 substantially fill the circular area of branching chamber 321. Other deformation shapes may be advantageous as mentioned above. Each deformed shape of outlet members 341, 361 and 381 of FIG. 5A is characterized by (for example, of the outlet member 341) a circular outer section 342 and one or more connecting, non-circular sections 343, 345. Such non-circular sections 343, 345 are cooperatively shaped with section 362 of outlet member 361 and 382 of outlet member 381 so as to maximize the internal radial cross-sectional areas of outlet members 341, 361 and 381.

FIGS. 5C and 5D illustrate the branching sub 301 of FIGS. 5A and 5B after its outlet members have been fully expanded after deployment in a parent well. Outlet members 361 and 381 are illustrated as having been simultaneously expanded in a gently curving path outwardly from the axis of branching chamber 321 and expanded radially to form circular tubular shapes from the deformed retracted state of FIGS. 5A and 5B.

Figure 6A:
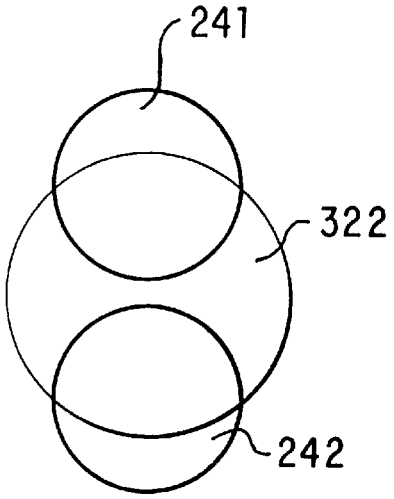
FIGS. 6A–6E illustrate radial cross-sections of several examples of branching outlet configurations of the branching sub according to the invention, with all outlet branches fully expanded from their retracted state during deployment in a parent well, with FIG. 6A illustrating two equal diameter outlet branches, FIG. 6B illustrating three equal diameter outlet branches, FIG. 6C, like FIG. 5C, illustrating three outlet branches with one branch characterized by a larger diameter than the other two, with FIG. 6D illustrating four equal diameter outlet branches, and with FIG. 6E illustrating five outlet branches with the center branch being of smaller diameter than the other four.
Figure 6B:
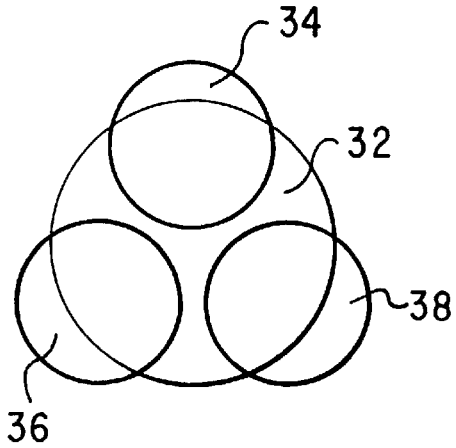
Figure 6C:
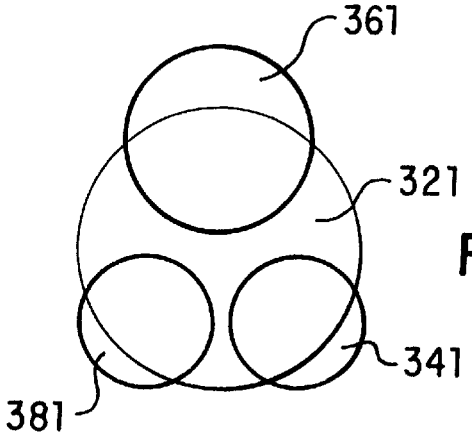
Figure 6D:
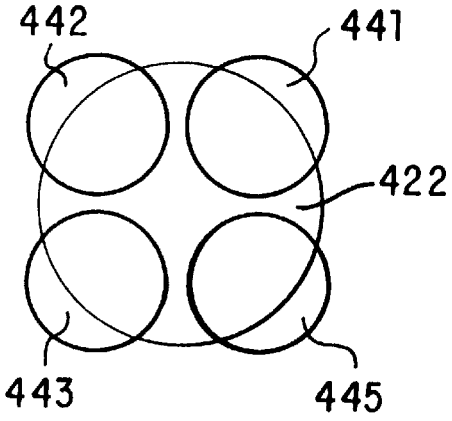
Figure 6E:
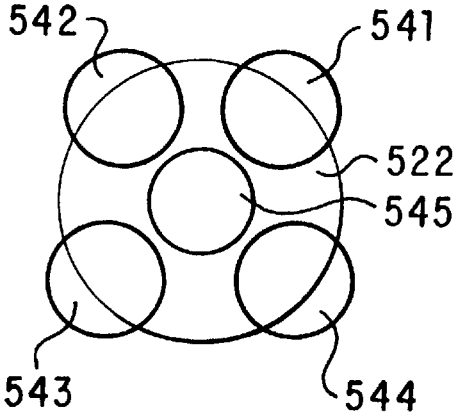

FIGS. 6A–6E show in schematic form the size of expanded outlet members as compared to that of the branching chamber. FIG. 6A shows two outlet members 241, 242 which have been expanded from a deformed retracted state. The diameters of outlet members 241 and 242 are substantially greater in an expanded state as compared to their circular diameters if they could not be expanded. FIG. 6B repeats the case of FIG. 3B. FIG. 6C repeats the uneven triple outlet configuration as shown in FIGS. 5A–5D. FIG. 6D illustrates four expandable outlet members from a branching chamber 422. Each of the outlet members 441, 442, 443, 445 are of the same diameter. FIG. 6E illustrates five outlet members, where outlet member 545 is smaller than the other four outlet members 541, 542, 543, 544. Outlet member 545 may or may not be deformed in the retracted state of the branching sub.

Description of Method for Expanding a Deformed Retracted Outlet Member

Figure 7A:
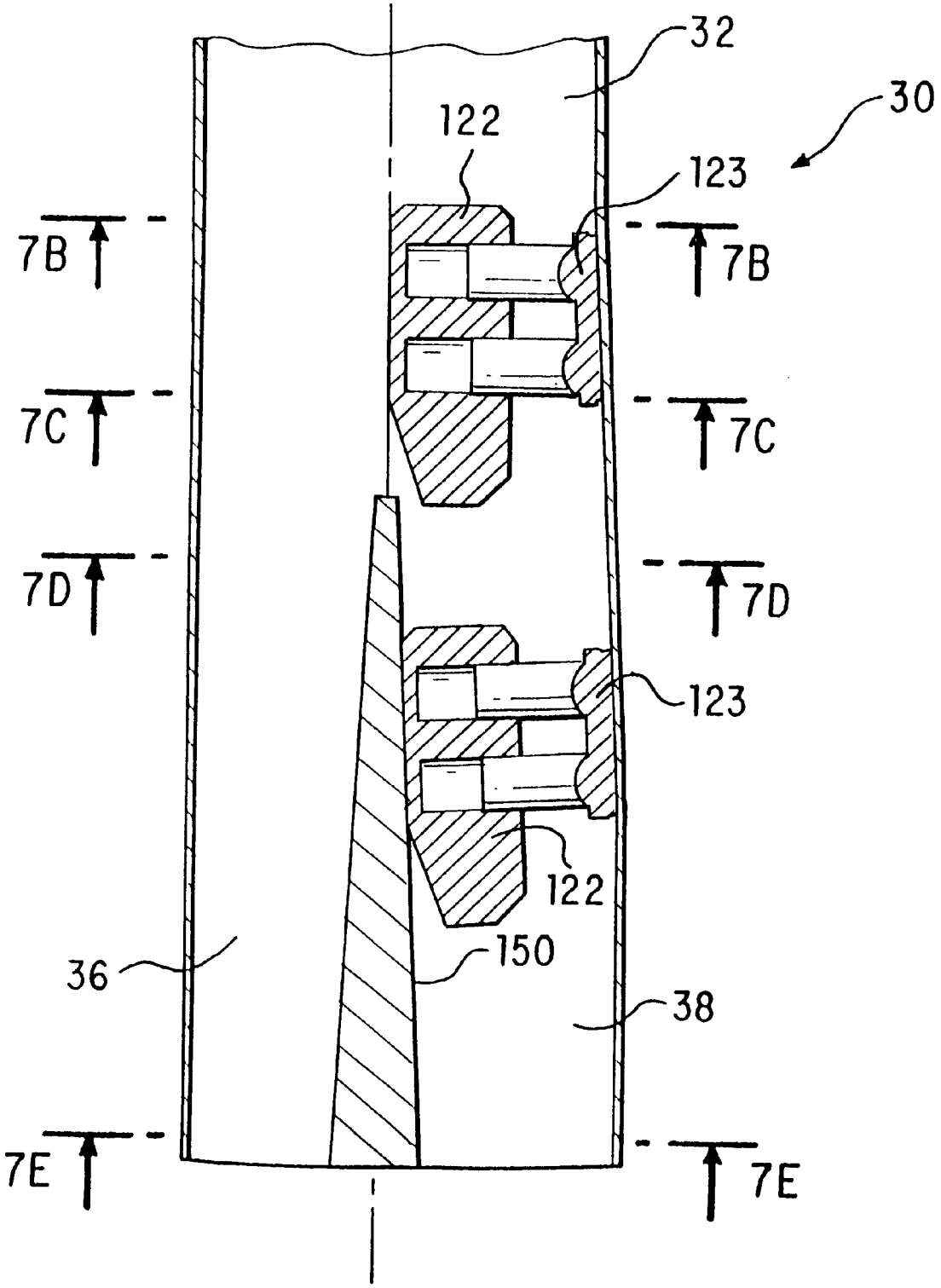
FIGS. 7A–7E illustrate stages of expanding the outlet members of an expandable branching sub according to the invention, with FIG. 7A illustrating an axial cross-section of the sub showing multiple branching outlets with one such outlet in a retracted position and the other such outlet being expanded starting with its connection to the branching head and continuing expansion downwardly toward the lower opening of the branching outlets, with FIG. 7B illustrating a radial cross-section at axial position B of FIG. 7A and assuming that each of three symmetrical branching outlets are being expanded simultaneously, and with FIGS. 7C through 7E showing various stages of expansion as a function of axial distance along the branching outlets.
Figure 7D:
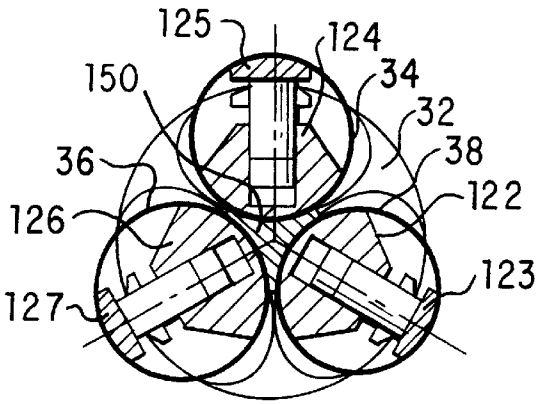
Figure 7E:
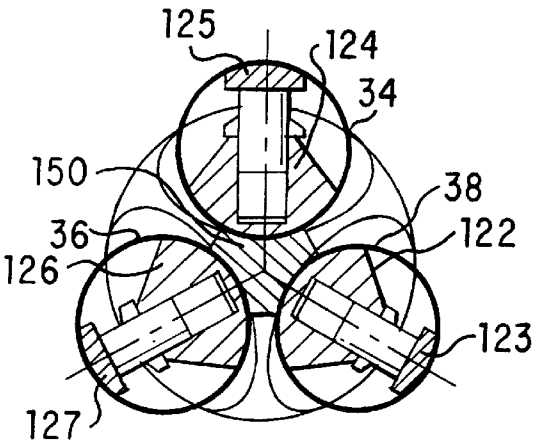
Figure 7B:
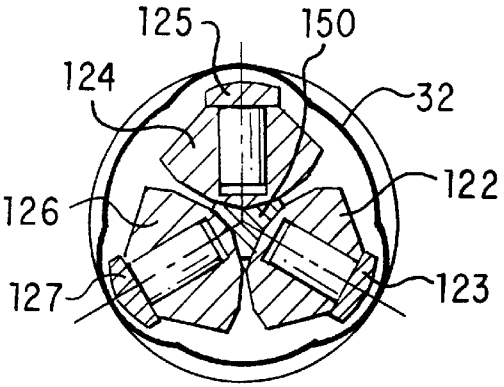
Figure 7C:
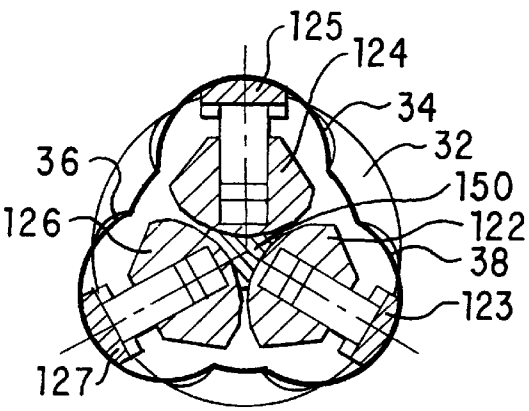

FIGS. 7A–7E illustrate downhole forming heads 122, 124, 126 operating at various depths in outlet members 38, 34, 36. As shown on the right hand side of FIG. 7A, a generalized forming head 122 is shown as it enters a deformed retracted outlet member, for example outlet member 38, at location B. Each of the forming heads 122, 124, 126 has not yet reached an outlet member, but the heads have already begun to expand the outlet wall of branching chamber 32 outwardly as illustrated in FIG. 7B. The forming heads 122, 124, 126 continue to expand the outlet members outwardly as shown at location C. FIG. 7C shows the forming heads 122, 124, 126 expanding the outlet members outwardly while simultaneously circularizing them. Forming pads 123, 125, 127 are forced outwardly by a piston in each of the forming heads 122, 124, 126. The forming heads simultaneously bear against central wall region 150 which acts as a reaction body so as to simultaneously expand and form the outlet members 38, 34, 36 while balancing reactive forces while expanding. FIGS. 7D and 7E illustrate the forming step locations D and E of FIG. 7A.

Figure 8A:
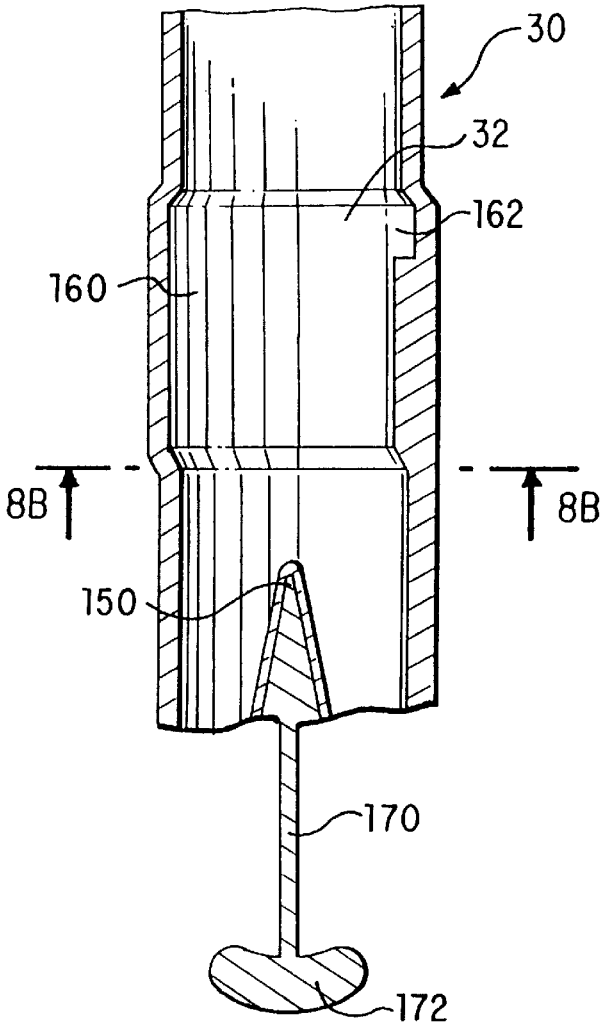
FIGS. 8A and 8B illustrate respectively in axial cross-section and a radial cross-section along lines 8B—8B, latching and orientation profiles of a branching chamber of the branching sub, and FIG. 8A further illustrates an extension leg and supporting shoe for deployment in a parent well and for providing stability to the branching sub while expanding the branching outlets from their retracted position.
Figure 8B:
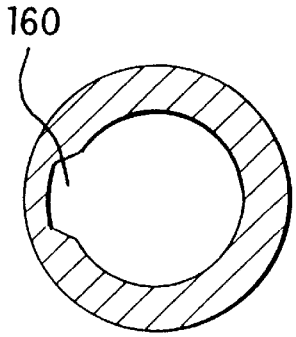

FIGS. 8A and 8B illustrate an axially extending slot 160 in the branching chamber 32 of branching sub 30. Such slot 160 cooperates with an orienting and latching sub of a downhole forming tool for radial positioning of such orienting and latching sub for forming and expanding the multiple outlet members downhole. A notch 162 in branching chamber 32 is used to latch the downhole forming tool at a predetermined axial position.

An extension leg 170 projects downwardly from the central wall region 150 of branching sub 30. A foot 172 is carried at the end of extension leg 170. In operation, foot 172 is lowered to the bottom of the borehole at the deployment location. It provides support to branching sub 30 during forming tool expanding and other operations.

Figure 9:
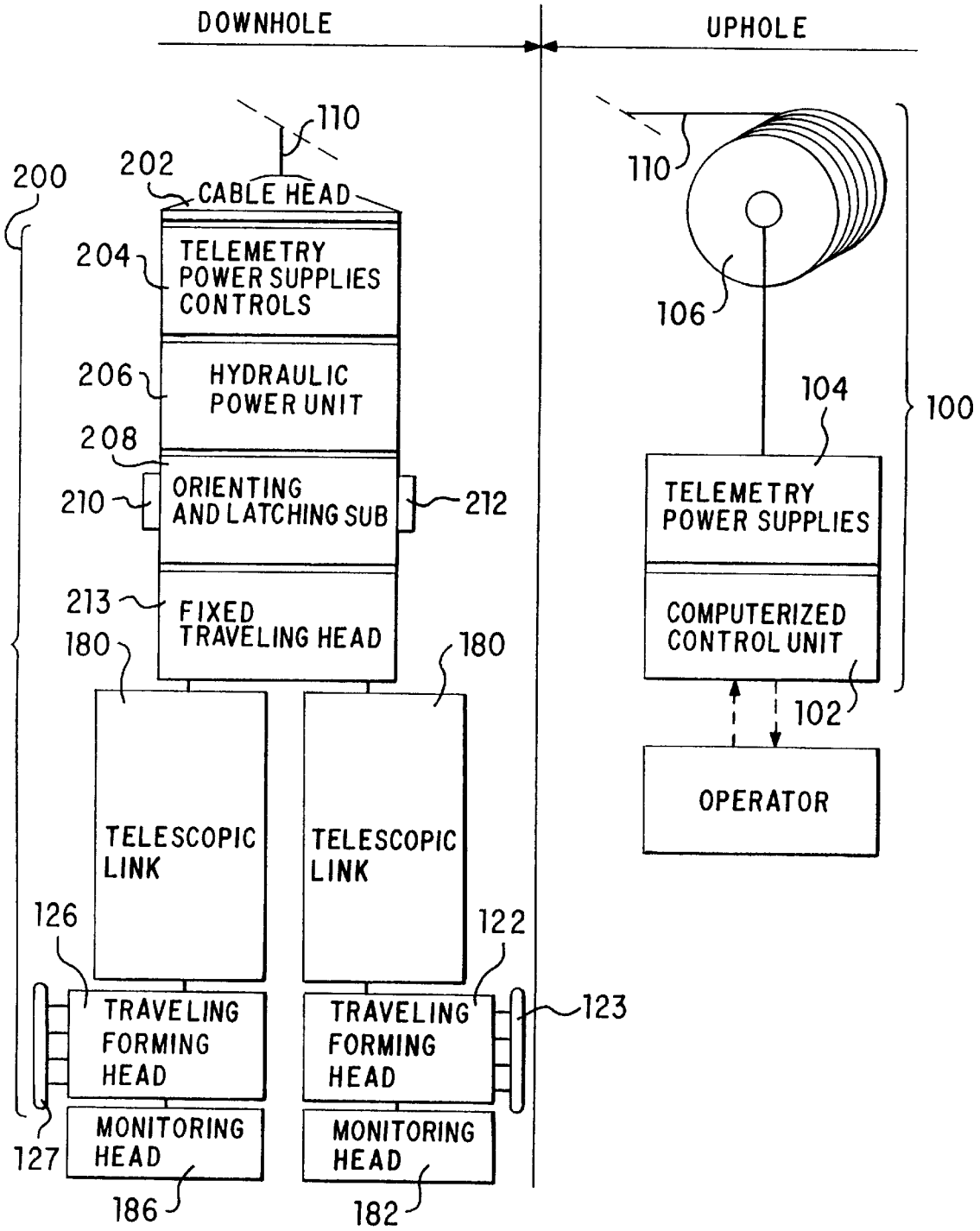
FIG. 9 schematically illustrates uphole and downhole apparatus for expanding the branching outlets of the branching sub.
Figure 10:
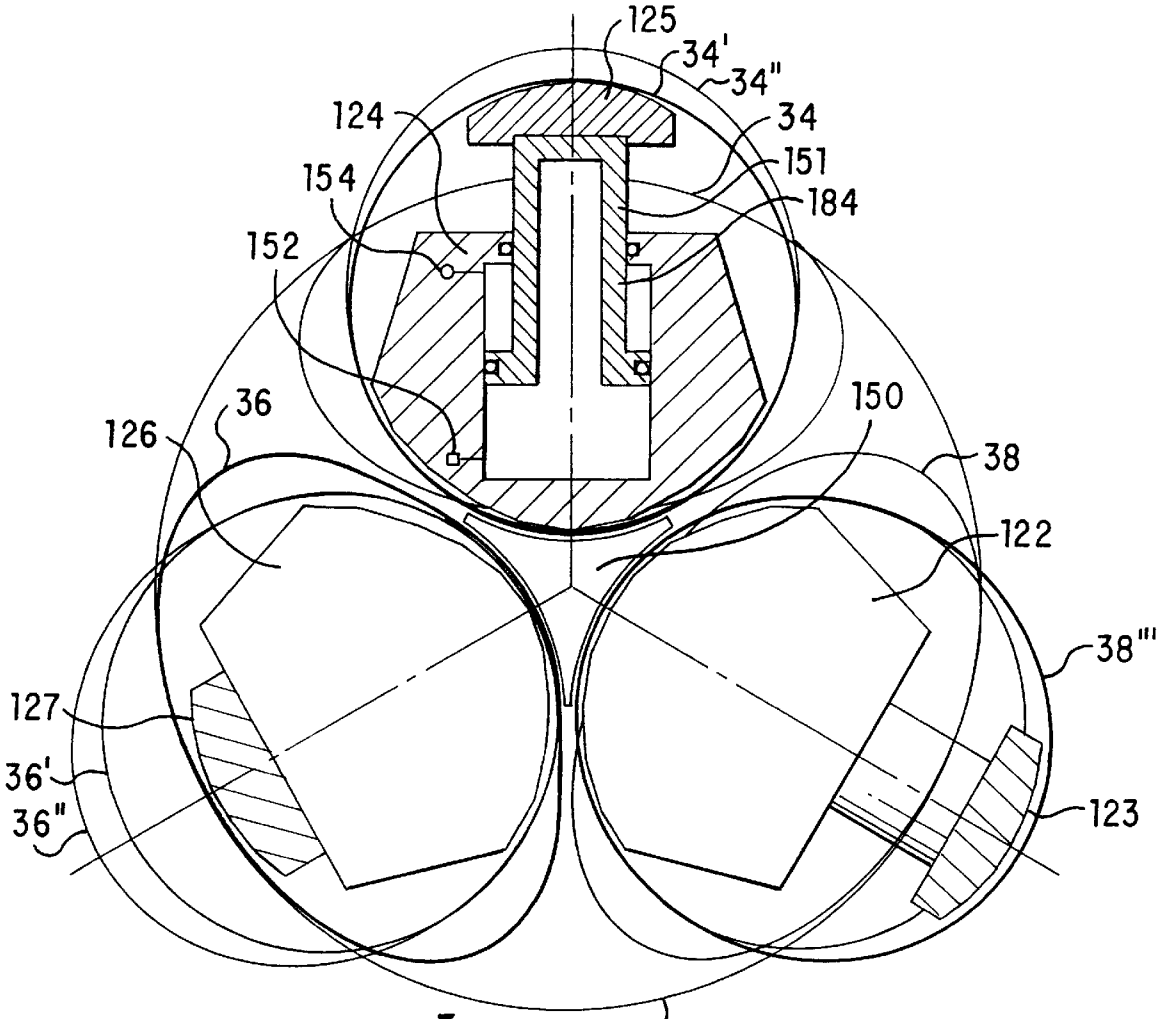
FIG. 10 illustrates steps of the process of expanding and forming the branching outlets with a pressure forming pad of the apparatus of FIG. 9.

Description of Forming Tool a) Description of Embodiment of FIGS. 9, 10

FIGS. 9 and 10 illustrate the forming tool used to expand multiple outlet members, for example outlet members 34, 36, 38 of FIGS. 3A, 3B, and 3C and FIGS. 7B, 7C, 7D and 7E. The forming tool includes uphole apparatus 1 00 and downhole apparatus 200. The uphole apparatus 100 includes a conventional computer 102 programmed to control telemetry and power supply unit 104 and to receive commands from and display information to a human operator. An uphole winch unit 106 has an electrical wireline 110 spooled thereon for lowering downhole apparatus 200 through a parent well casing and into the branching chamber 32 of a branching sub 30 which is connected to and carried at the end of the parent casing.

The downhole apparatus 200 includes a conventional cable head 202 which provides a strengthl/electrical connection to wireline 110. A telemetry, power supplies and controls module 204 includes conventional telemetry, power supply and control circuits which function to communicate with uphole computer 102 via wireline 110 and to provide power and control signals to downhole modules. Hydraulic power unit 206 includes a conventional electrically powered hydraulic pump for producing downhole pressurized hydraulic fluid. An orienting and latching sub 208 includes a latching device 210 (schematically illustrated) for fitting within notch 162 of branching chamber 32 of FIG. 8A and an orienting device 212 (schematically illustrated) for cooperating with slot 160 of branching chamber 32. When the downhole apparatus 200 is lowered into branching sub 30, orienting device 212 enters the slot 160 and the downhole apparatus 200 is further lowered until the latching device 210 enters and latches within notch 162.

Fixed traveling head 213 provides hydraulic fluid communication between hydraulic power unit 206 and the traveling forming heads 122, 124, 126, for example. Telescopic links 180 provide pressurized hydraulic fluid to traveling forming heads 122, 124, 126 as the heads 122, 124, 126 move downwardly within the multiple outlet members, for example outlet members 34, 36, 38 of FIGS. 7B–7E. Monitoring heads 182, 184, 186 are provided to determine the radial distance moved while radially forming an outlet member.

FIG. 10 illustrates traveling forming heads 126, 124, 122 in different stages of forming an outlet member of branching sub 30. Forming head 126 is shown in outlet member 36, which is illustrated by a heavy line before radial forming in the retracted outlet member 36. The outlet member is shown in light lines 36', 36". Where the outlet member is depicted as 36' in an intermediate stage of forming and as 36" in its final formed stage.

The forming head 124 is shown as it is radially forming retracted outlet member 34 (in light line) to an intermediate stage 34'. A final stage is illustrated as circularized outlet member 34". The forming head 124, like the other two forming heads 126, 122, includes a piston 151 on which forming pad 125 is mounted. Piston 151 is forced outwardly by hydraulic fluid applied to opening hydraulic line 152 and is forced inwardly by hydraulic fluid applied to closing hydraulic line 154. A caliper sensor 184 is provided to determine the amount of radial travel of piston 151 and forming pad 125, for example. Suitable seals are provided between the piston 151 and the forming head 124.

The forming head 122 and forming pad 123 are illustrated in FIG. 10 to indicate that under certain circumstances the shape of the outlet member 38 may be "over expanded" to create a slightly oblong shaped outlet, such that when radial forming force from forming pad 123 and forming head 122 is removed, the outlet will spring back into a circular shape due to residual elasticity of the steel outlet member.

At the level of the branching chamber 32, forming heads 122, 124, 126, balance each other against the reaction forces while forcing the walls of the chamber outwardly. Accordingly the forming heads 122, 124, 126 are operated simultaneously, for example at level B of FIG. 7A, while forcing the lower end of the wall of the branching chamber 32 outwardly. When a forming head 122 enters an outlet member 38 for example, the pad reaction forces are evenly supported by the central wall region 150 of the branching chamber 32. The telescopic links 180 may be rotated a small amount so that the forming pads 127, 125, 123 can apply pressure to the right or left from the normal axis and thereby improve the roundness or circularity of the outlet members. After a forming sequence is performed, for example at location D in FIG. 7A, the pressure is released from piston 151, and the telescopic links 180 lower the forming heads 122, for example, down by one step. Then the pressure is raised again for forming the outlet members and so forth.

Figure 15B:
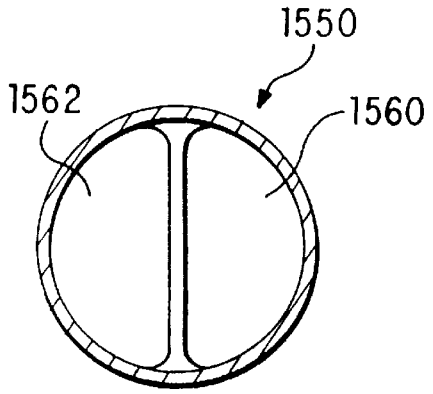
FIG. 15A illustrates a two outlet version of a branching sub according to the invention, with FIGS. 15B, 15B', 15C, and 15D illustrating cross-sectional profiles of such two outlet version of a branching sub with an alternative post-forming tool at various depth locations in the outlet members.
Figure 15B:
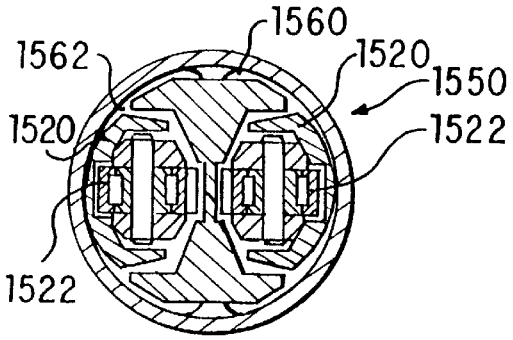
Figure 15C:
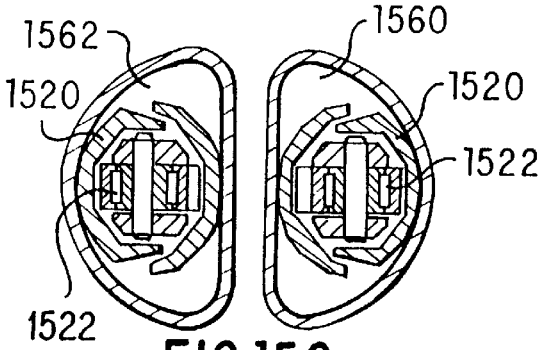
Figure 15D:
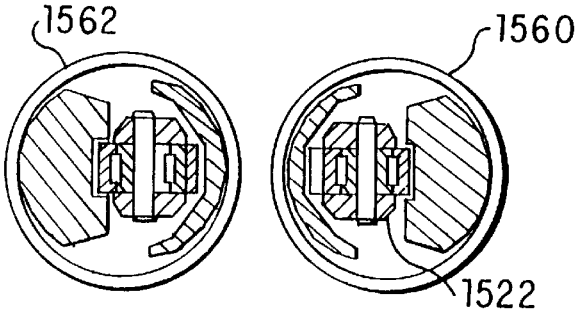
Figure 15A:
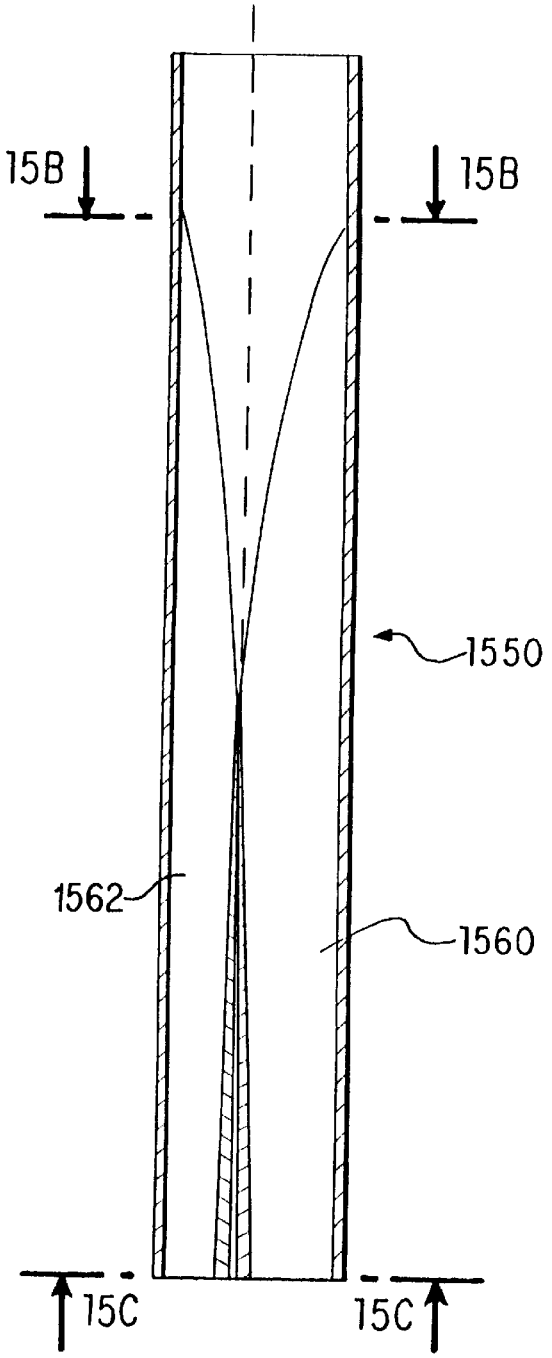
Figure 16:
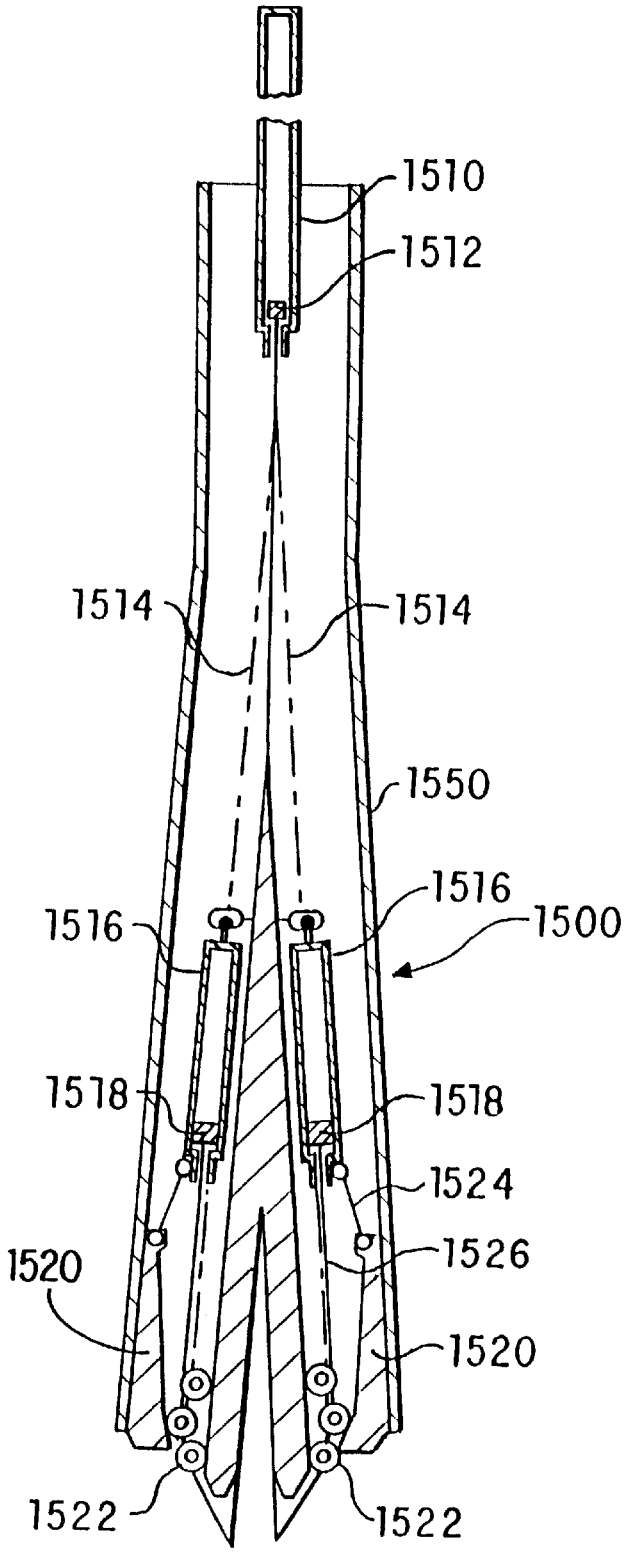
FIG. 16 illustrates a two arm alternative version of a post-forming tool.
Figure 17A:
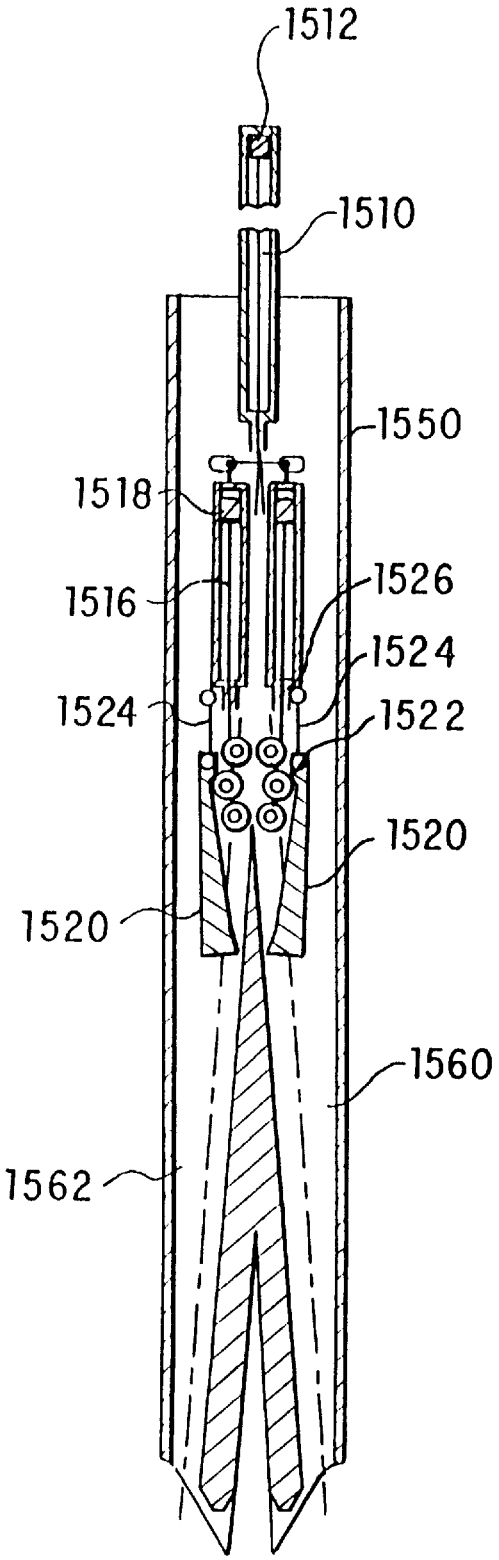
FIGS. 17A–17D illustrate the operation of such alternative post-forming tool.
Figure 17B:
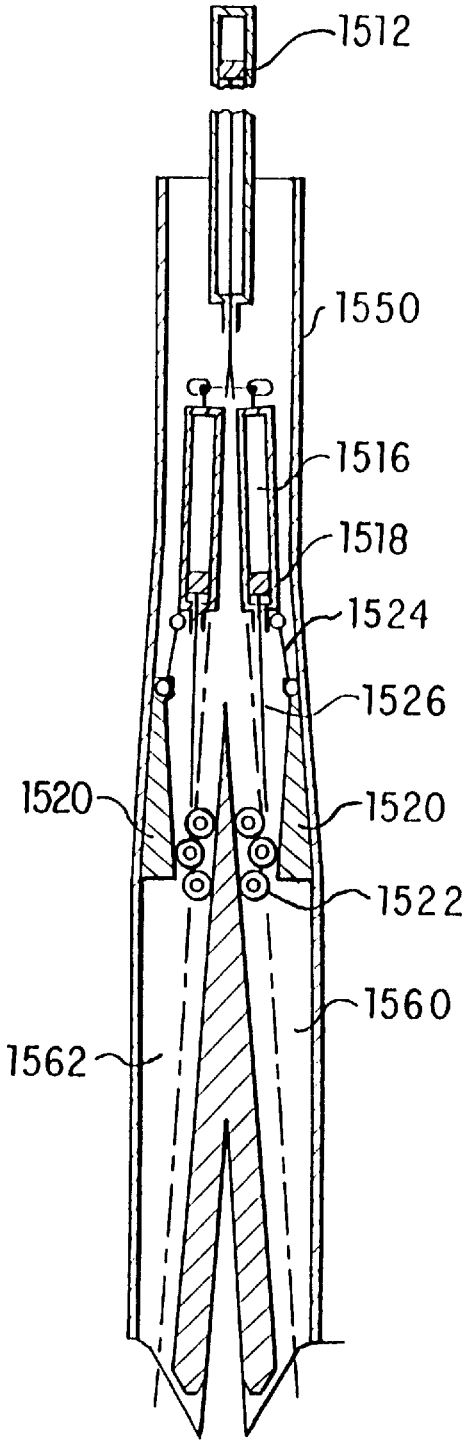
Figure 17C:
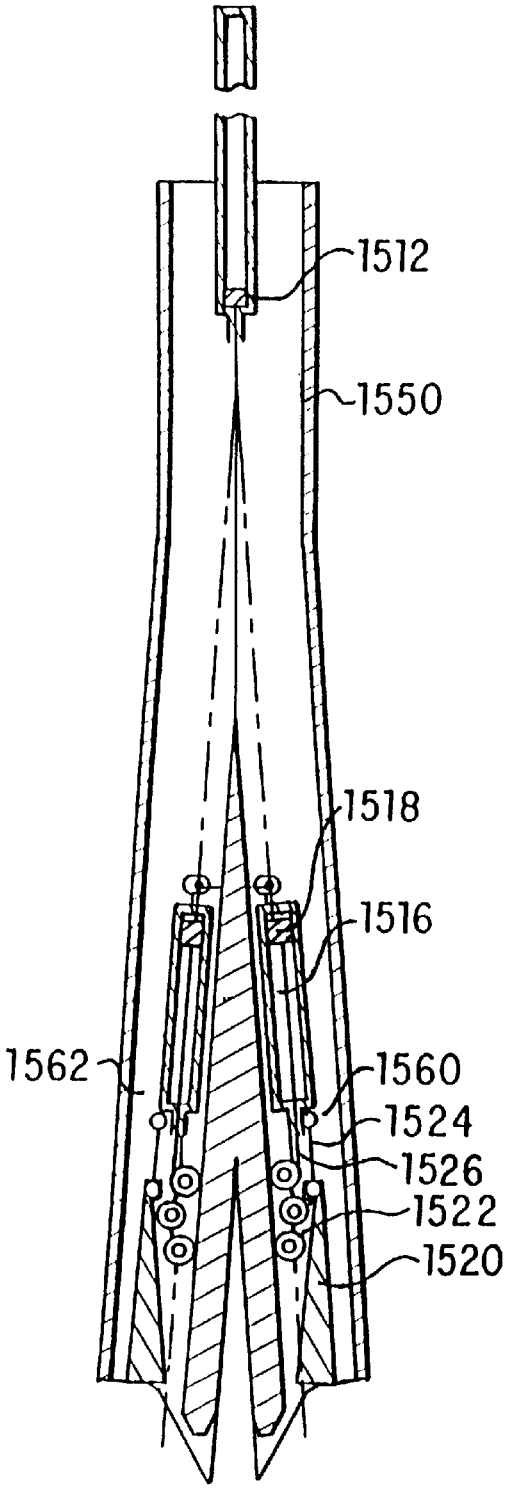
Figure 17D:
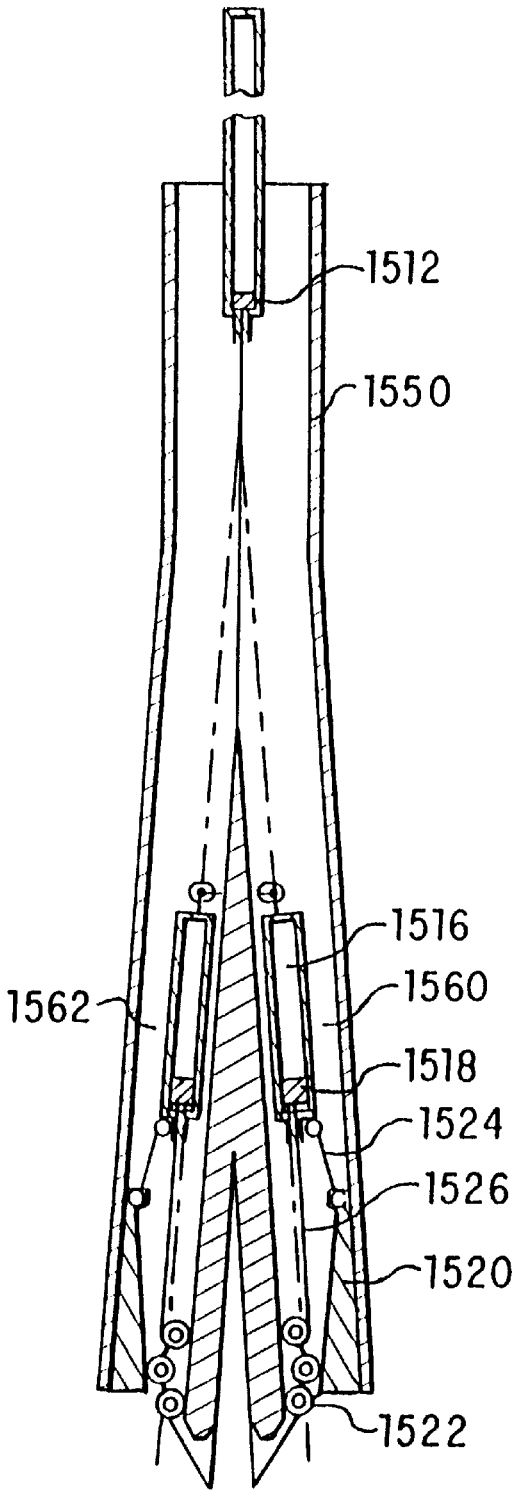

The composition of the materials of which the branching sub 30 is constructed is preferably of an alloy steel with austenitic structure, such as manganese steel, or nickel alloys such as "Monel" and "Inconel" series. Such materials provide substantial plastic deformation with cold forming thereby providing strengthening.

b) Description of Alternative Embodiment of FIGS. 15A–15D, 16 and 17A–17D An alternative post-forming tool is illustrated in FIGS. 15A, 15B, 15B', 15C, 15D, 16, and 17A–17D. The post-forming tool 1500 is supported by common downhole components of FIG. 9 including a cable head 202, telemetry, power supplies and controls module 204, hydraulic power unit 206 and an orienting and latching sub 208. FIG. 16 illustrates that post-forming tool 1500 includes a travel actuator 1510. A piston 1512 of travel actuator 1510 moves from an upper retracted position as shown in FIG. 17A to a lower extended position as shown in FIGS. 17C and 17D. FIG. 17B shows the piston 1512 in an intermediate position. Piston 1512 moves to intermediate positions depending on the desired travel positions of forming heads in the outlet members.

FIGS. 16 and 17D illustrate a two forming head embodiment of the post-forming tool 1500 where two outlet members (e.g., see outlet members 1560 and 1562 of FIGS. 15A–15D) are illustrated. Three or more outlet members may be provided with a corresponding number of forming heads and actuators provided. Links 1514 connect the piston 1512 to actuator cylinders 1516. Accordingly, actuator cylinders 1516 are forced downwardly into outlet members 1560, 1562 as piston 1512 moves downwardly.

Actuator cylinders 1516 each include a hydraulically driven piston 1518 which receives pressurized hydraulic fluid from hydraulic power unit 206 (FIG. 9) via travel actuator 1510 and links 1514. The piston 1518 is in an upper position as illustrated in FIGS. 17A and 17C and in a lower position as illustrated in FIGS. 17B and 17D.

The actuator cylinders 1516 are pivotally linked via links 1524 to forming pads 1520. The pistons 1518 are linked via rods 1526 to expanding rollers 1522. As shown in FIGS. 17A and 15B', the forming pads 1520 enter an opening of two retracted outlet members as illustrated in FIG. 15B. The expanding rollers 1522 and forming pads 1520 are in a retracted position within retracted outlet members 1560, 1562.

The piston 1512 is stroked downwardly a small amount to move actuator cylinders 1516 downwardly a small amount. Next, pistons 1518 are stroked downwardly causing expanding rollers 1522 to move along the inclined interior face of forming pads 1520 causing the pads to push outwardly against the interior walls of retracted outlet members 1560, 1562 until the outlet members achieve a circular shape at that level. Simultaneously, the outlet members are forced outwardly from the axis of the multiple outlet sub 1550. Next, the pistons 1518 are stroked upwardly, thereby returning the expanding rollers 1522 to the positions as shown in FIG. 15C. The piston 1512 is stroked another small distance downwardly thereby moving the forming pads 1520 her down into the outlet members 1560, 1562. Again, the pistons 1518 are stroked downwardly to further expand the outlet members 1560, 1562 outwardly and to circularize the outlets. The process is continued until the positions of FIGS. 15D and 17D are reached which illustrate the position of the forming pads 1520 and actuator cylinders 1516 at the distal end of the multiple outlet members 1560, 1562.

Description of Method for Providing Branch Wells

FIGS. 11A–11H and FIG. 12 describe the process for establishing branch wells from a branching sub 30 in a well. The branching sub 30 is illustrated as having three outlet members 34, 36, 38 (per the example of FIGS. 3A, 3B, 3C and FIGS. 7A–7E) but any number of outlets may also be used as illustrated in FIGS. 6A–6E. Only the outlets 38, 36 are illustrated from the axial cross-sectional views presented, but of course a third outlet 34 exists for a three outlet example, but it is not visible in the views of FIGS. 11A–11H or FIG. 12.

Figure 11A:
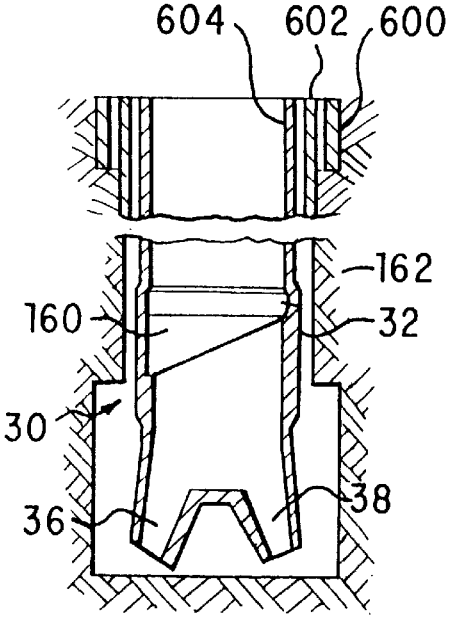
FIGS. 11A–11H illustrate steps of an installation sequence for a nodal branching sub and for creating branch wells from a parent well according to the invention.

FIG. 11A shows that the branching sub 30 is first connected to the lower end of a parent casing 604 which is conveyed through intermediate casing 602 (if present). Intermediate casing 602 lines the wellbore and is typically run through surface casing 600. Surface casing 600 and intermediate casing 602 are typically provided to line the wellbore. The parent casing 604 may be hung from intermediate casing 602 or from the wellhead at the surface of the earth or on a production platform.

The outlet members 36,38 (34 not shown) are in the retracted position. Slot 160 and notch 162 are provided in branching chamber 32 of branching sub 30 (see FIG. 12) to cooperate with orienting device 212 and latching device 210 of orienting and latching sub 208 of downhole apparatus 200 (See FIG. 9). When the parent casing 604 is set downhole, the branching sub 30 may be oriented by rotating the parent casing 604 or by rotating only the branching sub 30 where a swivel joint is installed (not illustrated) at the connection of the branching sub 30 with the parent well casing 604. The orienting process may be monitored and controlled by gyroscopic or inclinometer survey methods.

Figure 11B:
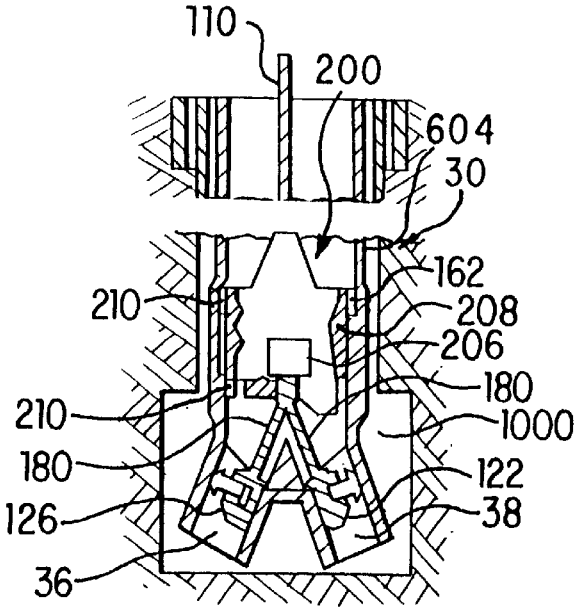

FIG. 11B illustrates the forming step described above with forming heads 122, 126 shown forming outlet members 38, 36 with hydraulic fluid being provided by telescopic links 180 from hydraulic power unit 206 and fixed traveling head 213. The outlet members 36, 38 are rounded to maximize the diameter of the branch wells and to cooperate by fitting with liner hangers or packers in the steps described below. The forming step of FIG. 11B also strengthens the outlet members 36, 38 by their being cold formed. As described above, the preferred material of the outlet members 36, 38 of the branching sub is alloyed steel with an austenitic structure, such as manganese steel, which provides substantial plastic deformation combined with high strengthening. Cold forming (plastic deformation) of a nickel alloy steel, such as "Inconel", thus increases the yield strength of the base material at the bottom end of the branching chamber 32 and in the outlet members 36, 38. The outlet members are formed into a final substantially circular radial cross-section by plastic deformation.

As described above, it is preferred under most conditions to convey and control the downhole forming apparatus 200 by means of wireline 110, but under certain conditions, e.g., under-balanced wellbore conditions, (or in a highly deviated or horizontal well) a coiled tubing equipped with a wireline may replace the wireline alone. As illustrated in FIG. 11B and described above, the downhole forming apparatus 200 is oriented, set and locked into the branching sub 30. Latching device 210 snaps into notch 162 as shown in FIG. 11B (see also FIG. 12). Hydraulic pressure generated by hydraulic power unit 206 is applied to pistons in forming heads 122, 126 that are supported by telescopic links 180. After a forming sequence has been performed, the pressure is released from the pistons, and the telescopic links 180 lower the forming pads down by one step. Then the pressure is raised again and so on until the forming step is completed with the outlet members circularized. After the outlet members are expanded, the downhole forming apparatus 200 is removed from the parent casing 604.

Figure 11C:
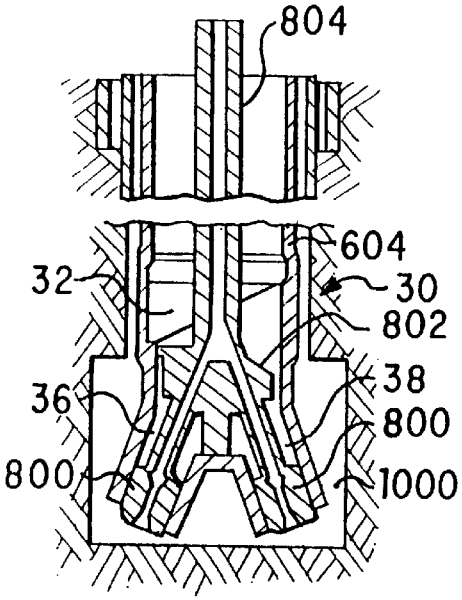
Figure 11D:
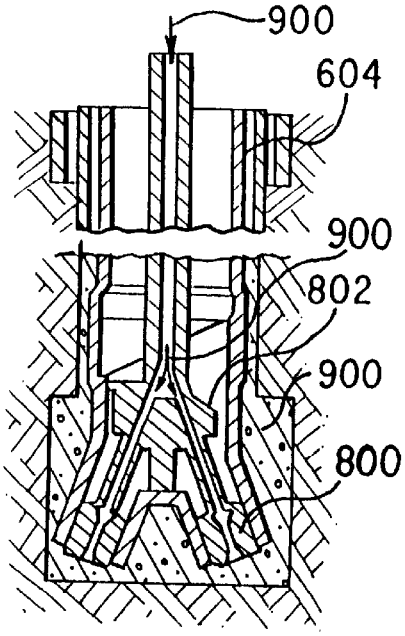
Figure 11E:
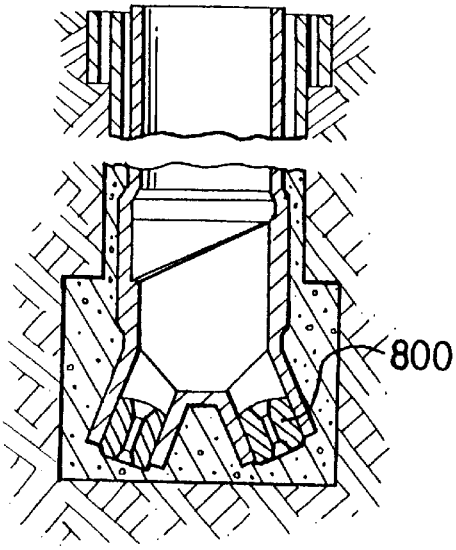

FIGS. 11C and 11D illustrate the cementing steps for connecting the parent casing 604 and the branching sub 30 into the well. Plugs or packers 800 are installed into the outlet members 36, 38. The preferred way to set the packers 800 is with a multiple head stinger 802 conveyed either by cementing string 804 or a coiled tubing (not illustrated). A multiple head stinger includes multiple heads each equipped with a cementing flow shoe. The stinger 802 is latched and oriented in the branching chamber 32 of branching sub 30 in a manner similar to that described above with respect to FIG. 11B. As illustrated in FIG. 11D, cement 900 is injected via the cementing string 804 into the packers 800, and after inflating the packers 800 flows through conventional check valves (not shown) into the annulus outside parent casing 604, including the bottom branching section 1000. Next, the cementing string 804 is pulled out of the hole after disconnecting and leaving packers 800 in place as shown in FIG. 11E.

Figure 11F:
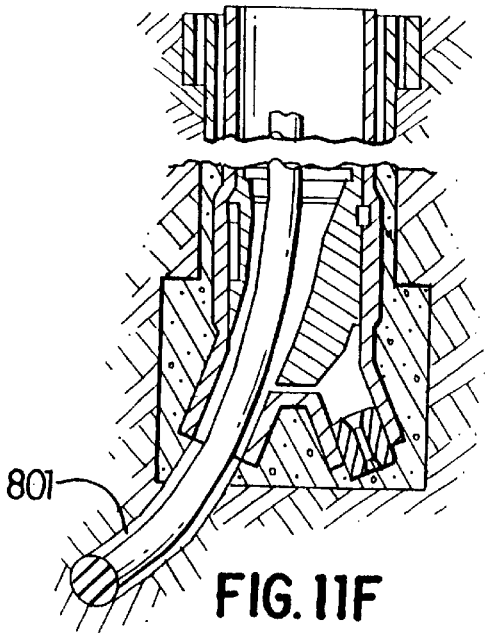
Figure 11G:
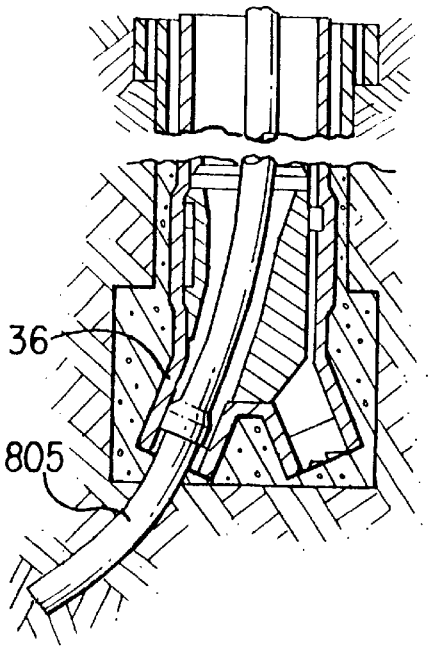
Figure 11H:
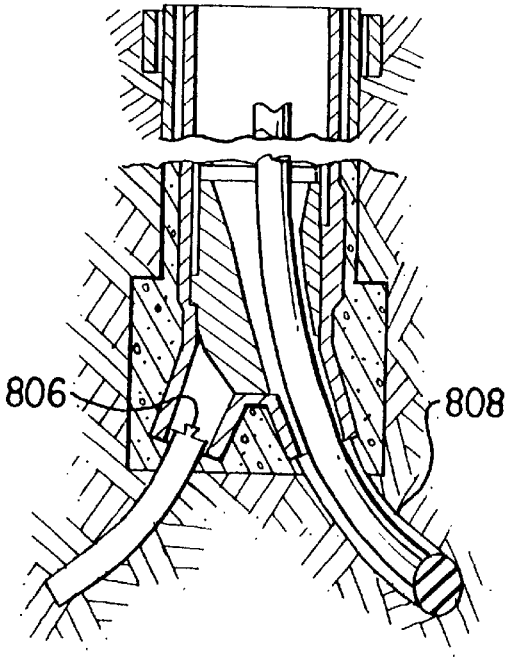

As shown in FIG. 11F, individual branch wells (e.g. 801) are selectively drilled using any suitable drilling technique. After a branch well has been drilled, a liner 805 is installed, connected, and sealed in the outlet member, 36 for example, with a conventional casing hanger 806 at the outlet of the branching sub 30 (See FIGS. 11G and 11H). The liner may be cemented (as illustrated in FIG. 11G) or it may be retrievable depending on the production or injection parameters, and a second branch well 808 may be drilled as illustrated in FIG. 11H.

Figure 12:
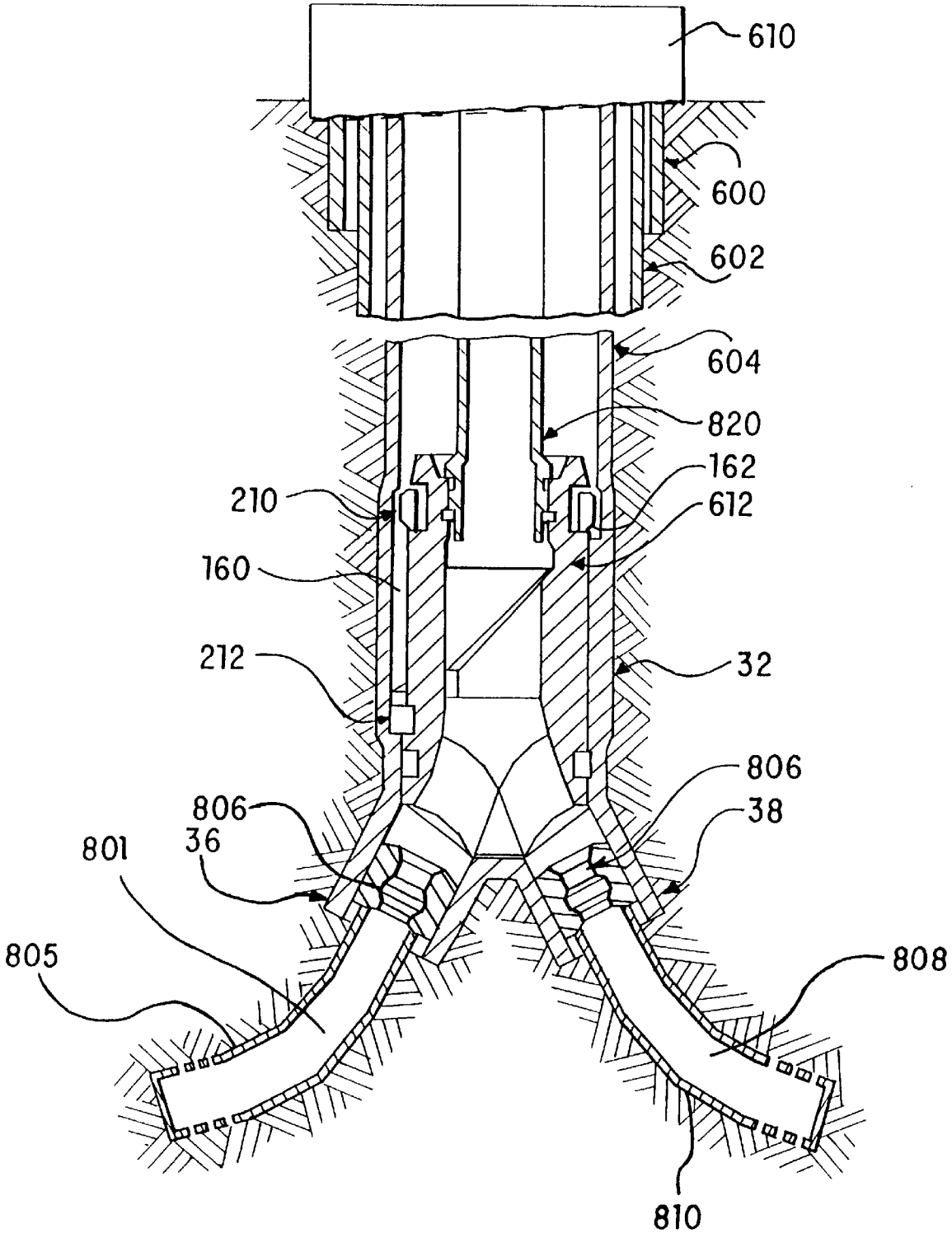
FIG. 12 illustrates a branching sub deployed in a parent well and further illustrates branch well iners hung from branching outlets and still further illustrates production apparatus deployed in the branching sub for controlling production from branch wells into the parent well.

FIG. 12 illustrates completion of branch wells from a branching sub at a node of a parent well having parent casing 604 run through intermediate casing 602 and surface casing 600 from wellhead 610. As mentioned above, parent casing 604 may be hung from intermediate casing 602 rather than from wellhead 610 as illustrated. The preferred method of completing the well is to connect the branch wells 801, 808 to a downhole manifold 612 set in the branching chamber 32 above the junction of the branch wells 801, 808. The downhole manifold 612 is oriented and latched in branching chamber 32 in a manner similar to that of the downhole forming tool as illustrated in FIGS. 8A, 8B and 11B. The downhole manifold 612 allows for control of the production of each respective branch well and provides for selective re-entry of the branch wells 801, 808 with testing or maintenance equipment which may be conveyed through production tubing 820 from the surface.

In case of remedial work in the parent casing 604, the downhole manifold 612 can isolate the parent well from the branch wells 801, 808 by plugging the outlet of the downhole manifold 612. This is done by conveying a packer through production tubing 820, and setting it in the outlet of downhole manifold 612 before disconnecting and removing the production tubing 820. Valves controllable from the surface and testing equipment can also be placed in the downhole equipment. The downhole manifold 612 can also be connected to multiple completion tubing such that each branch well 801, 808 can be independently connected to the surface wellhead.

Figure 13A:
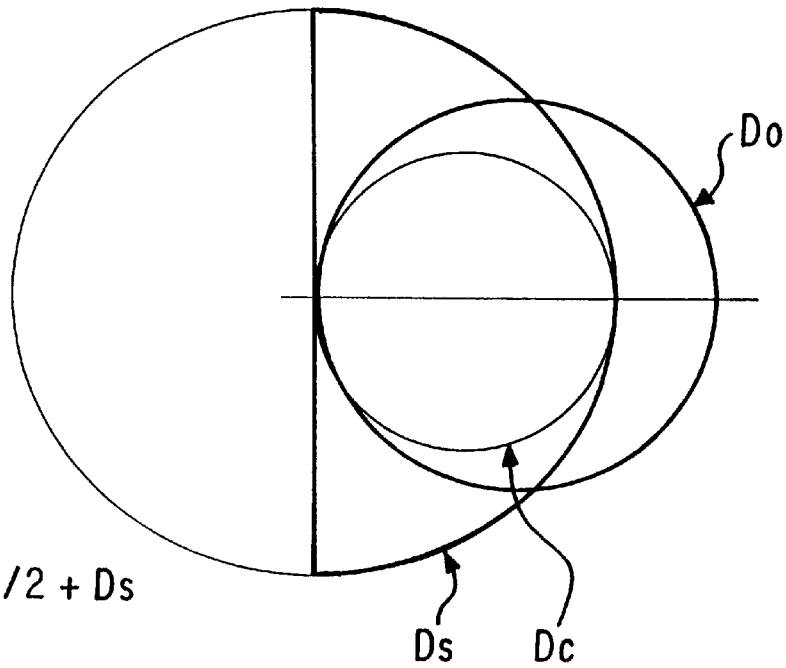
FIGS. 13A and 13B geometrically illustrate the increase in branch well size achievable for this invention as compared with prior art conventional axial branch wells from liners packed at the end of parent casing.
Figure 13B:
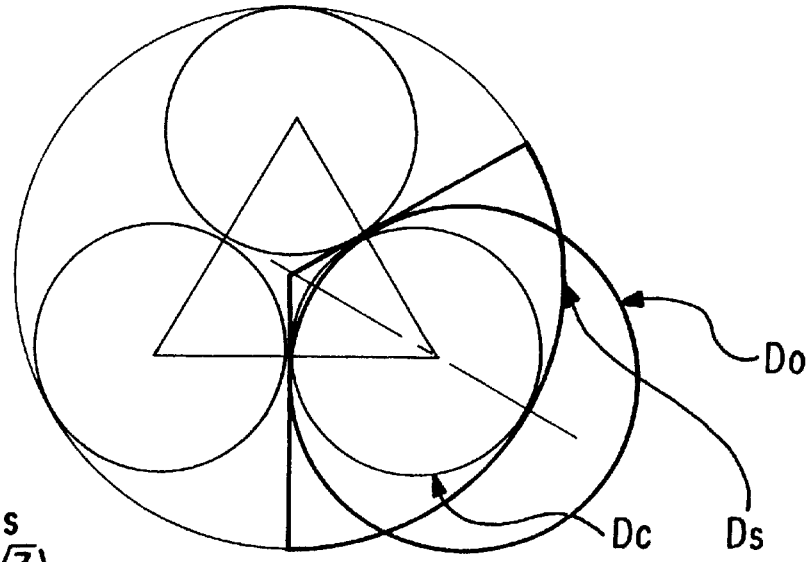

The use of a branching sub for branch well formation, as described above, for a triple branch well configuration, allows the use of dramatically smaller parent casing as compared to that required in the prior art arrangement of FIGS 1A and 1B. The relationships between the branching sub diameter $D_s$, the maximum expanded outlet diameter $D_o$, and the maximum diameter of a conventional axial branch $D_c$ for a two outlet case is shown in FIG. 13A, and for a three outlet case in FIG. 13B. The same kind of analysis applies for other multiple outlet arrangements. In comparison to an equivalent axial branching that could be made of liners packed at the end of the parent casing, the branching well methods and apparatus of the present invention allow a gain in branch cross-sectional area ranging from 20 to 80 percent.

Figure 14B:
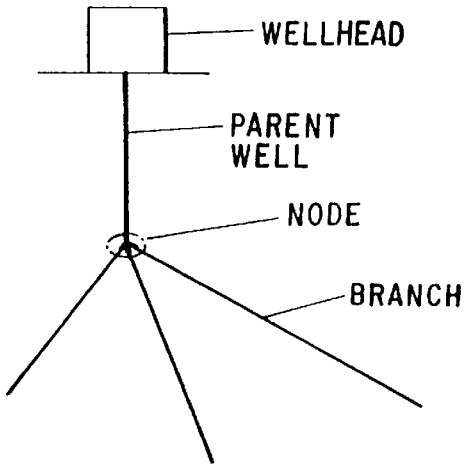
Figure 14B:
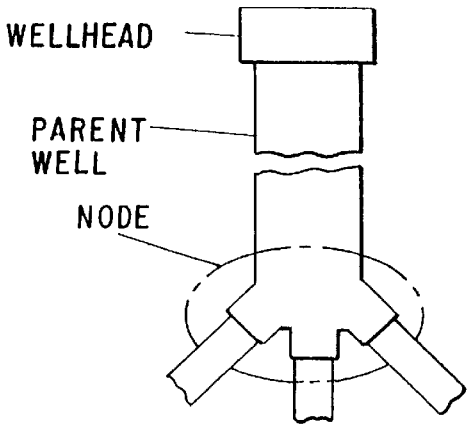
Figure 14C:
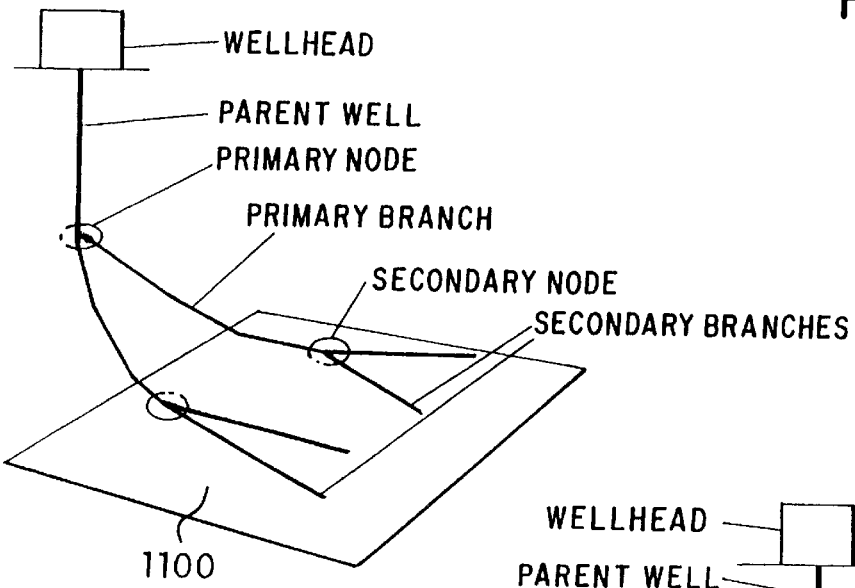
Figure 14D:
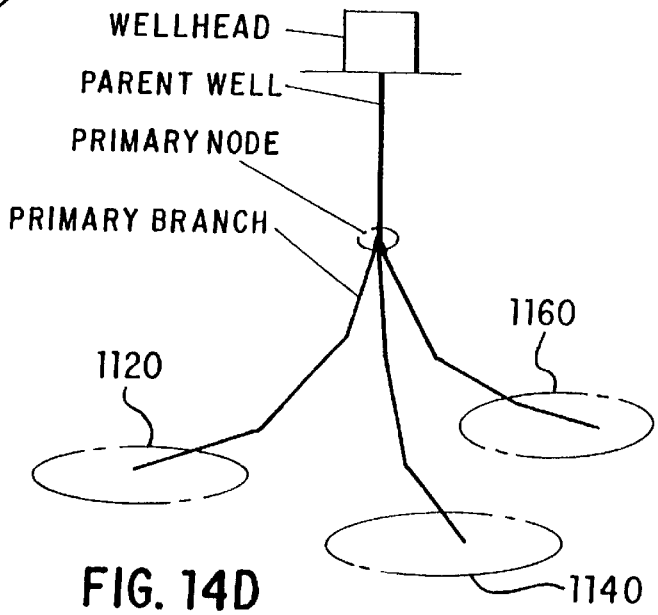

FIGS. 14A–14D illustrate various uses of two node branch well configurations according to the invention. FIGS. 14A and 14B illustrate a branching sub at a node according to the invention. FIG. 14C illustrates how branch wells may be used to drain a single strata or reservoir 1100, while FIG. 14D illustrates the use of a single node by which multiple branch wells are directed to different target zones 1120, 1140, 1160. Any branch well may be treated as a single well for any intervention, plugging, or abandonment, separate from the other wells.

Various modifications and alterations in the described methods and apparatus will be apparent to those skilled in the art of the foregoing description which do not depart from the spirit of the invention. For this reason, such changes are desired to be included within the scope of the appended claims which include the only limitations to the present invention. The descriptive manner which is employed for setting forth the embodiments should be interpreted as illustrative but not limitative.

What is claimed is:

1. Apparatus arranged and designed for expanding an outlet of a multiple branching sub in a cased borehole, where said sub includes a branching chamber having a first end, and a second end, and multiple branching outlet members each of which is connected to said second end of said branching chamber, with said branching outlet members being in a retracted condition in which each of said outlet members is substantially totally within an imaginary cylinder which is coaxial with and substantially the same radius as said first end of said branching chamber, said apparatus including:

an uphole power and control unit;

a downhole operational unit; and an electrical wireline means connected between said uphole power and control unit and said downhole operational unit for providing a path for electrical power and electrical communication signals therebetween;

said downhole operational unit including a forming mechanism arranged and designed for insertion in a retracted branching outlet member of said sub for expanding at least one of said multiple outlet members so that it extends in an arcuate path from said branching chamber outwardly of said imaginary cylinder.

2. The apparatus of claim 1 wherein said downhole operational unit includes:

means for latching said downhole operational unit at a predetermined axial position within said multiple branching sub; and means for radially orienting said forming mechanism such that said forming mechanism is aligned with a selected branching outlet member of said sub.

3. The apparatus of claim 2 wherein said downhole operational unit further includes:

hydraulic pump means for pressurizing hydraulic fluid;

a head having hydraulic fluid lines connected to said hydraulic pump means; and wherein said forming mechanism includes a hydraulically powered forming pad and a link between said forming pad and said head for providing pressurized hydraulic fluid to said forming pad.

4. The apparatus of claim 3 wherein said forming mechanism includes a piston for forcing said forming pad outwardly against said outlet member.

5. The apparatus of claim 3 wherein said forming pad includes an inclined interior surface and said forming mechanism includes rollers coupled to said link for cooperating with said inclined interior surface to force said forming pad outwardly against said outlet member.

6. The apparatus of claim 5 further including an expanding actuator having a cylinder body coupled to said forming pad by means of a pivotal link and having a piston coupled to said rollers by means of a rod.

7. The apparatus of claim 6 further including a travel actuator including a piston which is linked structurally and hydraulically to said cylinder body of said expanding actuator.

* * * * *